US008480325B2

(12) United States Patent
Gallardo

(10) Patent No.: US 8,480,325 B2
(45) Date of Patent: Jul. 9, 2013

(54) PAINT TRIMMER

(75) Inventor: Jose Antonio Gallardo, Castaic, CA (US)

(73) Assignee: Arigala Painting, Inc., Castaic, CA (US)

( * ) Notice: Subject to any disclaimer, the term of this patent is extended or adjusted under 35 U.S.C. 154(b) by 650 days.

(21) Appl. No.: 12/635,679

(22) Filed: Dec. 10, 2009

(65) Prior Publication Data

US 2010/0092232 A1 Apr. 15, 2010

Related U.S. Application Data

(63) Continuation-in-part of application No. 11/834,882, filed on Aug. 7, 2007, now Pat. No. 7,909,529, and a continuation-in-part of application No. 29/329,214, filed on Dec. 10, 2008, now Pat. No. Des. 592,406.

(51) Int. Cl.

| | |
|---|---|
| ***A46B 9/08*** | (2006.01) |
| ***A46B 11/00*** | (2006.01) |
| ***A46B 15/00*** | (2006.01) |
| ***A46B 17/04*** | (2006.01) |
| ***A46B 17/08*** | (2006.01) |

(52) U.S. Cl.
USPC ..... 401/188 R; 401/14; 401/193; 401/48; 15/114

(58) Field of Classification Search
USPC ..... 401/14, 23, 24, 37, 48, 193; 15/106, 15/114, 118, 160, 210.1; 16/422, 430, 436, 16/DIG. 24, DIG. 41
See application file for complete search history.

(56) References Cited

U.S. PATENT DOCUMENTS

| | | | | |
|---|---|---|---|---|
| 4,235,192 | A * | 11/1980 | Brubaker | 118/504 |
| 4,516,521 | A * | 5/1985 | Szelagowski et al. | 118/50 |
| 5,331,710 | A * | 7/1994 | Tollasepp | 15/210.1 |
| 5,443,533 | A * | 8/1995 | Magnien | 15/210.1 |
| 6,035,806 | A * | 3/2000 | Lorenzo | 119/603 |
| 6,425,701 | B1 * | 7/2002 | Jacobs | 401/6 |
| 6,543,954 | B2 * | 4/2003 | Owings | 401/185 |
| 6,817,801 | B1 * | 11/2004 | Colburn et al. | 401/205 |
| 7,028,363 | B1 * | 4/2006 | Gartner | 15/210.1 |
| 2006/0130254 | A1 * | 6/2006 | Futo et al. | 15/114 |
| 2009/0064829 | A1 * | 3/2009 | Frank et al. | 81/489 |

* cited by examiner

*Primary Examiner* — David Walczak
*Assistant Examiner* — Joshua Wiljanen
(74) *Attorney, Agent, or Firm* — Kelly & Kelley, LLP

(57) ABSTRACT

The paint trimmer includes a rigid base and a handle removably attachable to the base. The handle includes a bladder for storing paint. A paint applicator is associated with the base and fluidly coupled to the bladder via a manifold. Accordingly, a user may selectively dispense paint from the bladder to the paint applicator via the manifold for application to a surface to be painted. A paint mask associated with the base and offset from the paint applicator prevents paint from dispensing to undesired locations of the surface.

23 Claims, 21 Drawing Sheets

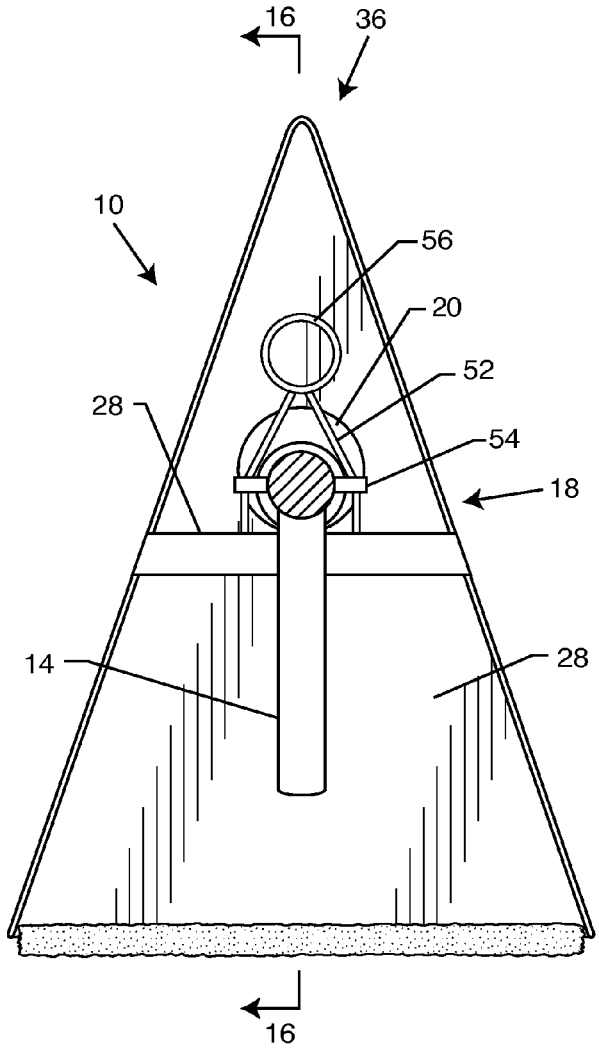
FIG. 15
FIG. 16
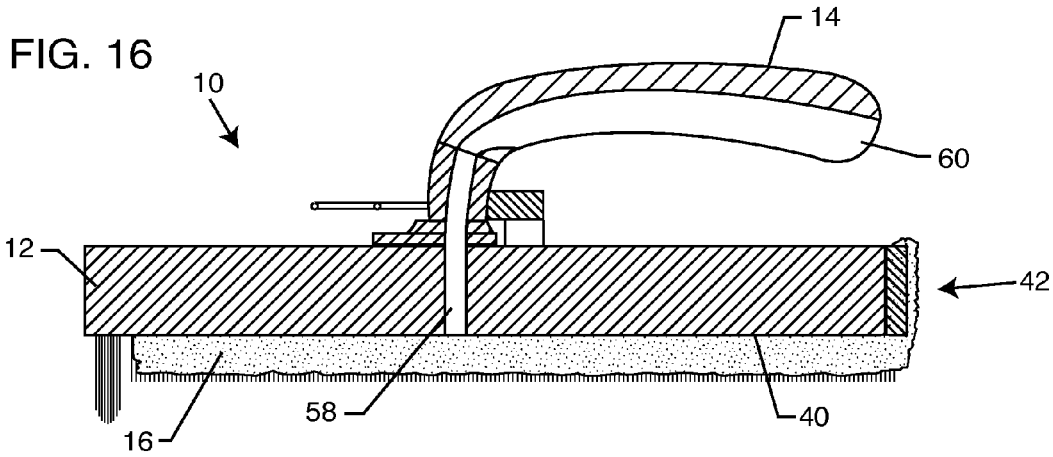

PAINT TRIMMER

BACKGROUND OF THE INVENTION

The present invention relates to a paint trimmer and more particularly to a paint trimmer having a paint mask guide and a handle with a bladder integral therewith.

The accurate application of paint along an edge or a straight line using a hand-held paint trimmer is a highly skilled task that requires experience and a far steadier hand than possessed by most people. Traditional methods for accurately painting along an edge or painting a straight line involved applying a length of masking tape that shields the edge or defines the boundary of the straight line to remain unpainted. The masking tape is then removed once the paint is applied thereby leaving an unpainted edge or a painted straight line. Unfortunately, this masking tape method can be messy, costly and time consuming.

Another method for painting along an edge or painting a straight line involves using a brush or other paint applicator in one hand along with a shield or other masking guide in another hand. As with masking tape, the shield or masking guide is held against a surface or an edge while paint is applied. The shield or masking guide is moved along the surface as paint is applied. This method requires two steady, dexterous hands and can be just as messy and time consuming as applying paint via the masking tape method.

In view of the foregoing disadvantages of traditional methods of painting, there is a need for an improved paint trimmer that is cleaner, cost effective and efficient. Such a paint trimmer with an integral masking guide should eliminate the need for masking tape. Further, the paint trimmer with an integral masking guide should include a handle and base configured for one handed operation to paint a straight line or a clean edge. The present invention fulfills these needs and provides further related advantages.

SUMMARY OF THE INVENTION

The paint trimmer disclosed herein generally includes a rigid base and a handle selectively removably attachable to the base. In a preferred embodiment, the handle includes a bladder and rotates relative to the base. An integral lock non-removably secures the handle relative to the base at any location within the 360° rotational range of the handle. The base includes a slat that selectively slidably receives a hook and flange extending from the handle for securing the handle to the base. In one embodiment, the handle attaches to a base that is triangular and includes a set of elongated bristles having a beveled edge at one vertex thereof.

The paint trimmer further includes a paint applicator associated with the base and a manifold fluidly coupling the bladder to the paint applicator. In a preferred embodiment, the manifold is disposed between the base and the paint applicator. The manifold includes a channel fluidly coupled to the bladder for dispensing paint from the bladder to the paint applicator. In one embodiment, the bladder may include a chamber in the handle or a compartment (e.g. a diaphragm) selectively attachable to the handle. The bladder fluidly couples to the paint applicator through a passageway in the base. The handle may include a guide pin that selectively aligns the handle with the base and further fluidly couples the bladder to the manifold. The bladder may include an integral squeezable pump for dispensing paint. The bladder may also be selectively refillable via a one-way valve.

In another aspect of the paint trimmer, a paint mask associated with the base and is offset from the paint applicator to prevent paint from being dispensed from the paint applicator exterior to the outer perimeter of the paint trimmer. This is particularly useful when painting around objects such as the trim around a door. A set of bristles disposed between the paint applicator and the paint mask ensure consistent application of paint along the edge of the paint mask. The paint trimmer may further include a position controller associated with the paint mask and the handle to selectively adjust the height of the paint mask relative to the paint dispenser. When the paint mask is in a lower position, the paint trimmer is ideal for painting around the aforementioned door trim. Alternatively, when the paint mask is in an upper position, the paint trimmer is ideal for painting large surface areas of a wall.

The paint trimmer may further include a set of beveled bristles integrated into the paint applicator, for painting tight corners. Moreover, a perimeter paint applicator may be disposed at least partially around the exterior of the base to diversify the combination of painting features available with the paint trimmer. Also in this regard, the paint trimmer may include a hinged paint applicator coupled to the base. Preferably, the hinged paint applicator either vertically or horizontally pivots relative to the base. The hinged paint applicator is another tool integral with the paint trimmer for detailing smaller surface areas than could not otherwise be painted with the relatively larger paint applicator.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 15 is a top view of an alternative paint trimmer having an activation ring;

FIG. 16 is a cross-sectional view of the alternative paint trimmer taken along line 16-16 of FIG. 15, illustrating the guide in the upper position;

BRIEF DESCRIPTION OF THE PREFERRED EMBODIMENTS

Figure 1:
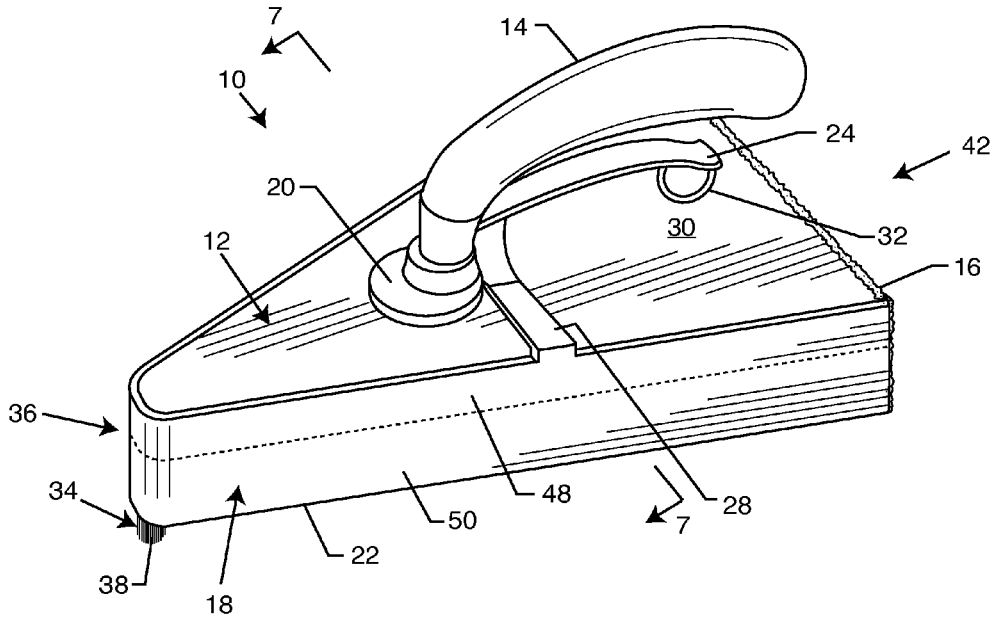
FIG. 1 is a perspective view of one embodiment of a paint trimmer.
Figure 2:
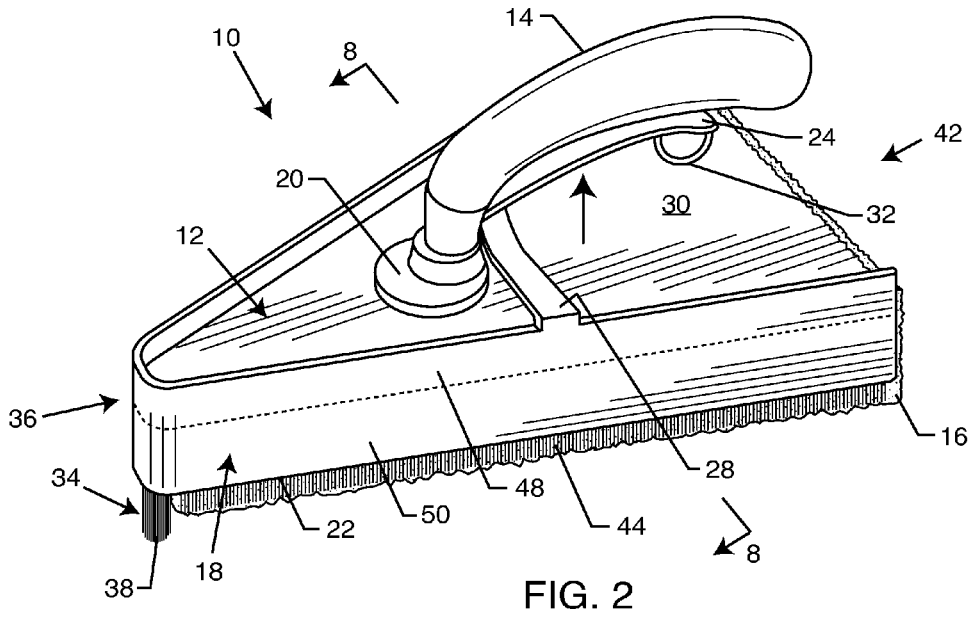
FIG. 2 is a perspective view of the paint trimmer of FIG. 1, illustrating exposure of a plurality of side bristles through upward movement of an applicator guide.
Figure 3:
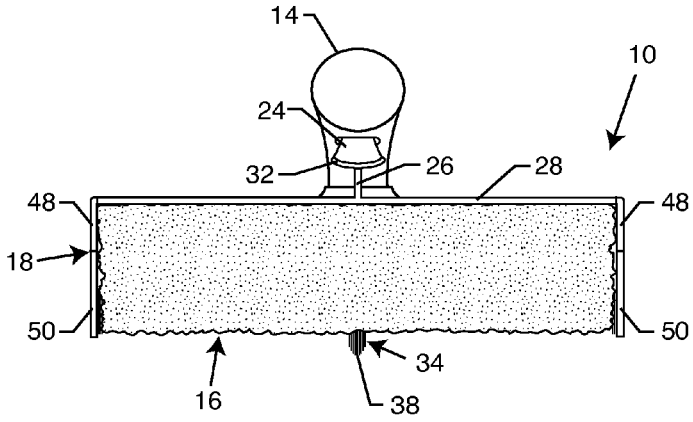
FIG. 3 is a rear view of the paint trimmer of FIG. 1.
Figure 4:
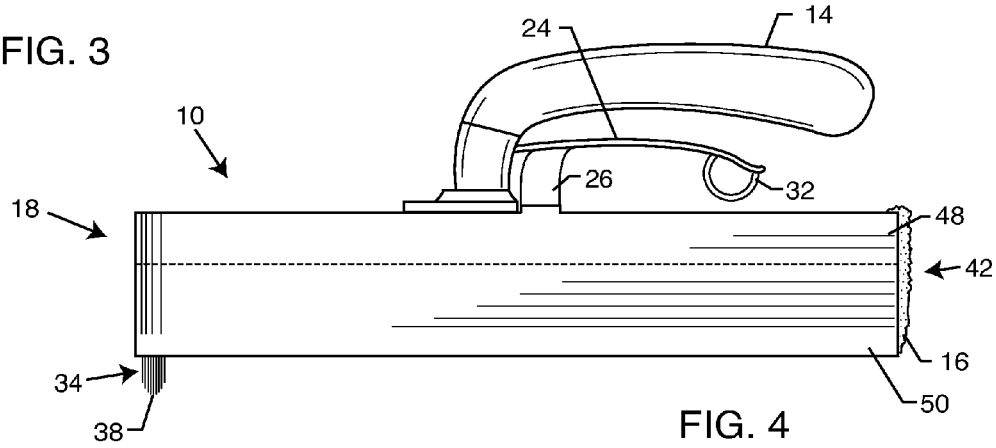
FIG. 4 is a side view of the paint trimmer of FIG. 1, illustrating the applicator guide in a lower position encompassing the plurality of side bristles.
Figure 5:
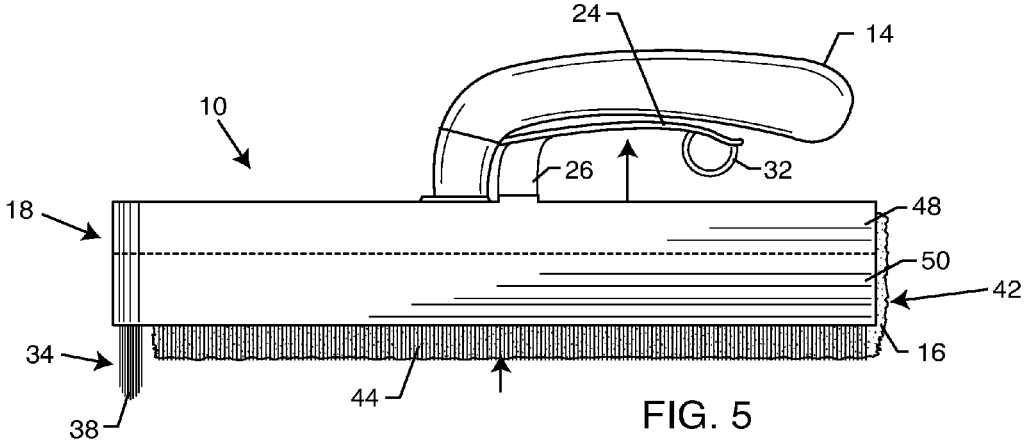
FIG. 5 is a side view of the paint trimmer illustrating exposure of the side bristles when the applicator guide is in an upper position.
Figure 6:
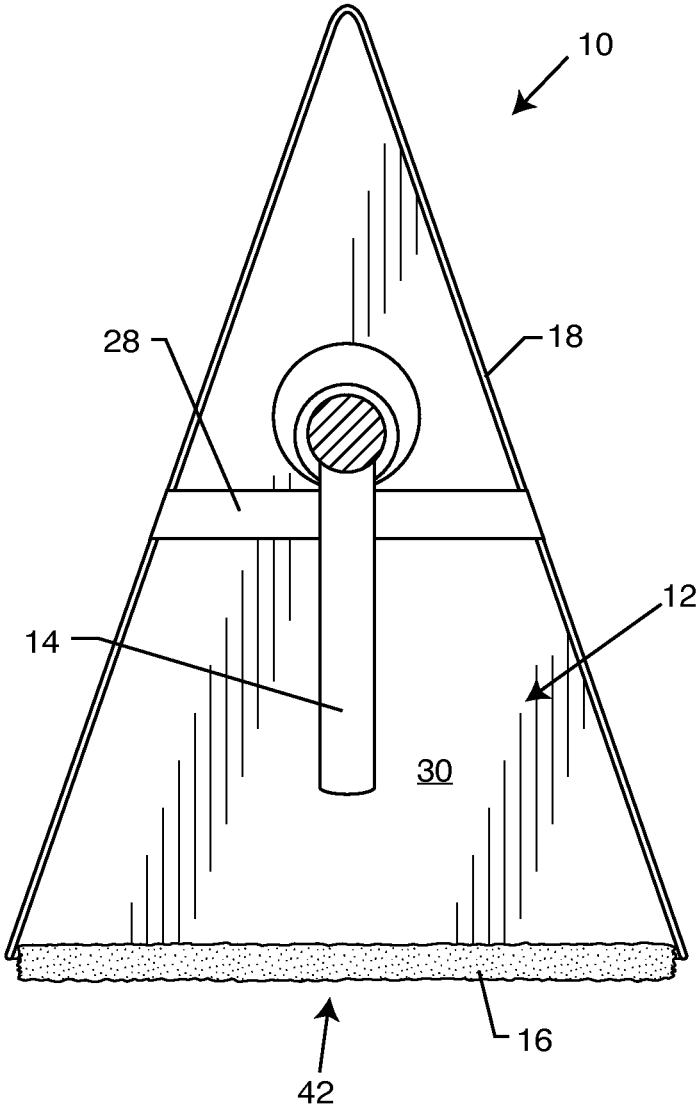
FIG. 6 is a top view of the paint trimmer of FIG. 1.
Figure 7:
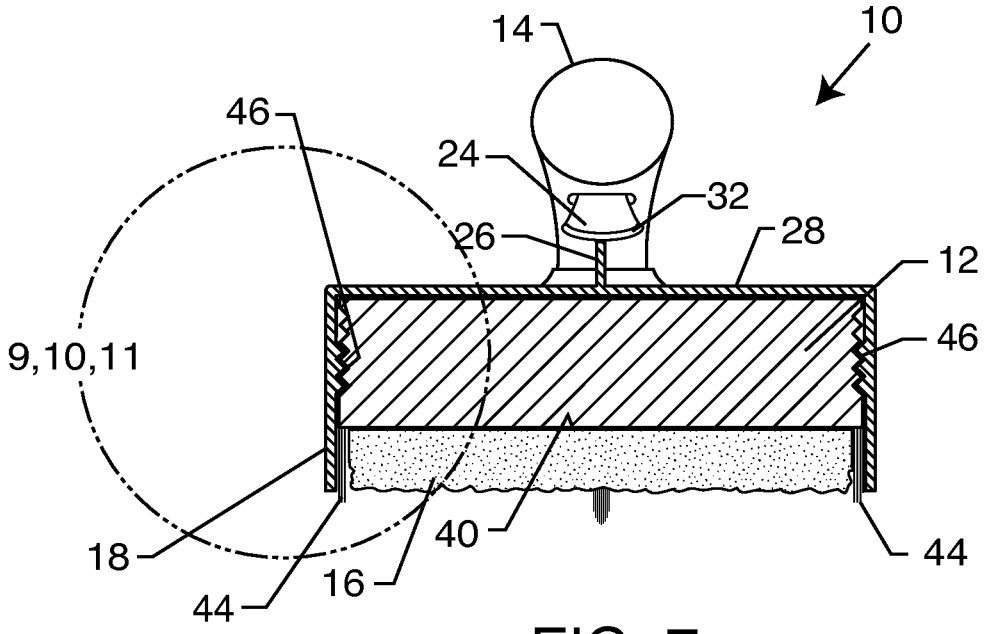
FIG. 7 is a cross-sectional view taken along line 7-7 of FIG. 1, illustrating the applicator guide in the lower position.
Figure 8:
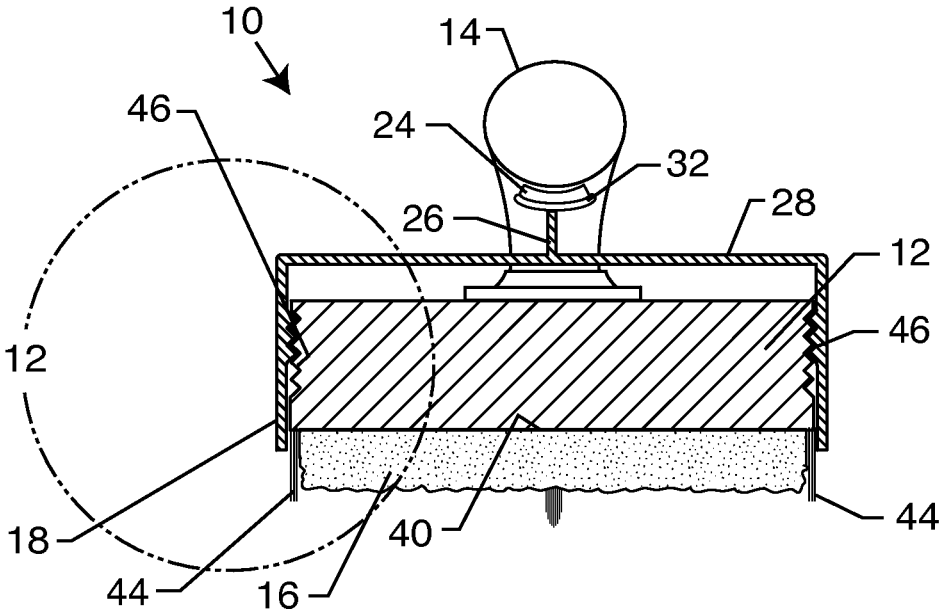
FIG. 8 is a cross-sectional view taken along line 8-8 of FIG. 2, illustrating the applicator guide in the upper position.

As shown in the drawings for purposes of illustration, the present invention for a hand-held paint trimmer is generally referred to by the reference number 10. As shown in FIG. 1, the paint trimmer 10 generally includes a base 12, a handle 14, a paint applicator 16, and an applicator guide 18. In one embodiment, the handle 14 statically attaches to the base 12 via a universal connection mechanism 20. The connection mechanism 20 may, as described in more detail below with respect to alternative embodiments, enable the handle 14 to selectively disconnect from the base 12, rotate relative to the base 12, dispense paint or otherwise activate the positioning of the applicator guide 18. At least with respect to FIGS. 1-8, the handle 14 is used in conjunction with the base 12 to selectively position the applicator guide 18 between a lower position (FIGS. 1, 4 and 7) and an upper position (FIGS. 2, 5 and 8). More specifically, the paint trimmer 10 is ideal for painting large surface areas when the applicator guide 18 is in the upper position because the paint applicator 16 is fully exposed. Alternatively, the paint trimmer 10 is ideal for painting along an edge or a straight line when the applicator guide 18 is in the lower position because the paint applicator 16 is generally enclosed and unable to dispense paint beyond the applicator guide 18. Accordingly, the applicator guide 18 prevents paint disposed on the paint applicator 16 from bleeding beyond a guide edge 22. The guide edge 22 enables a user to abut the paint trimmer 10 against objects (e.g. door jambs or doorframes) the user endeavors to paint around.

In one embodiment, the applicator guide 18 is positionable between the lower position (FIGS. 1, 4 and 7) and the upper position (FIGS. 2, 5 and 8) through actuation of a trigger 24. The trigger 24 couples to the applicator guide 18 via an extension 26 that rigidly attaches to a bridge 28 extending over an upper surface 30 of the base 12. A user may selectively move the trigger 24 relative to the handle 14 to selectively position the applicator guide 18 between the lower and upper positions. The applicator guide 18 travels in a defined track through attachment to the trigger 24 via the extension 26 and the bridge 28. Accordingly, a user may shift the applicator guide 18 between the upper and lower positions relative to the base 12 due, in part, to the pivoting relationship of the trigger 24 relative to the handle 14. As shown in FIGS. 1-8, the applicator guide 18 encompasses at least the two equal sides of the isosceles triangle-shaped base 12. More generally, the applicator guide 18 should be configured to encompass the outer perimeter of the base 12 regardless of shape. The base 12 is preferably triangular so a user may reach corners or other recesses to apply paint via the paint applicator 16. The base 12 itself may be constructed from wood, metal, plastic or any other material appropriate for forming the paint trimmer 10.

The trigger 24 may operate in any number of ways designed to achieve the desired raising and/or lowering of the applicator guide 18. In one preferred embodiment, as best illustrated in FIGS. 1-5, the trigger 24 is positioned beneath the handle 14. A user grasps the paint trimmer 10 by the handle 14 and wraps one or more fingers around the trigger 24. The user may place a finger, preferably the little finger, into a trigger ring 32 positioned near the end of the trigger 24. To raise the applicator guide 18, the user squeezes the fingers toward the palm to draw the trigger 24 closer to the handle 14. This raises the bridge 28 by virtue of being connected thereto via the extension 26. Consequently, movement of the trigger 24 results in movement of the applicator guide 18 by virtue of being connected to the corresponding bridge 28. The relative positioning of the applicator guide 18 is best shown between FIG. 1 (lower position) and FIG. 2 (upper position), between FIG. 4 (lower position) and FIG. 5 (upper position), and between FIG. 7 (lower position) and FIG. 8 (upper position). Sample movement of the trigger 24 is shown in FIGS. 2 and 5. To lower the applicator guide 18, the user may simply release the trigger 24 and allow gravity to return the applicator guide 18 to the lower position. When the trigger 24 is not subject to gravitational forces, a user may return the applicator guide 18 to the lower position by pulling the trigger 24 away from the handle 14 through use of the trigger ring 32. This movement returns the extension 26, the bridge 28 and the corresponding applicator guide 18 to the lower position. The static positioning of the trigger 24 relative to the extension 26, the bridge 28, and the applicator guide 18 facilitates such movement. Accordingly, pushing the trigger 24 away from the handle 14 effectively returns the applicator guide 18 to the lower position as shown best in FIGS. 1, 4 and 7.

As briefly described above, the paint trimmer 10 is preferably triangularly shaped. As shown in the preferred embodiments, the base 12 and the corresponding paint applicator 16 are generally in the shape of an isosceles triangle. The paint trimmer 10 includes a set of extended bristles 34 protruding out from a vertex 36 at the forward end (i.e. the tip of the isosceles triange) of the base 12 relative to the handle 14. The vertex 36 of the base 12 preferably includes the set of extended bristles 34 having a beveled tip 38, as shown in FIGS. 1-5. The extended bristles 34 and the beveled tip 38 are of the type commonly found on paint brushes. The extended bristles 34 are particularly useful for painting corners and recesses that may otherwise be inaccessible by rounded and/or square paint brushes. Positioning the extended bristles 34 at the vertex 36 also enables a user to paint narrow corners.

The paint applicator 16 preferably comprises a lambs wool or synthetic material as is commonly found on paint rollers or other similar painting devices. The paint applicator 16 attaches to the base 12 along a lower surface 40 (best shown in FIGS. 7-8, 16). The paint applicator 16 is preferably disposed along the entire area of the lower surface 40 to maximize the paint application area of the paint trimmer 10. Moreover, the paint applicator 16 may also wrap around a back side 42 (FIGS. 1-2 and 4-5) of the base 12. Here, the paint applicator 16 extends up about the back side 42 toward the upper surface 30 of the base 12. In this way, the paint applicator 16 may receive paint directly thereon from placement in a paint tray. Alternatively, the paint applicator 16 may receive paint via any of the other embodiments described herein.

The paint tool 10 further includes a set of side bristles 44 that line the longitudinal sides of the base 12. The side bristles 44 assist in the application of paint to a surface along the guide edge 22 of the applicator guide 18. Paint tends to be more uniformly straight when applied by the side bristles 44 rather than when applied by the paint applicator 16 alone. This occurs because the side bristles 44 are generally more rigid than the material comprising the paint applicator 16. Moreover, the side bristles 44 are longer than the thickness of the paint applicator 16. FIGS. 2 and 5 illustrate the side bristles 44 extending beyond and actually masking the paint applicator 16. The side bristles 44 are preferably positioned along at least the sides of the applicator guide 18. In the embodiments shown with respect to FIGS. 1-8, the side bristles 44 are positioned along the two equal sides of the isosceles triangle encased by the applicator guide 18, and not the back side 42 of the paint trimmer 10 having the paint applicator 16 (i.e. the odd third side). As best shown in FIGS. 7 and 8, the side bristles 44 are located between the exterior sidewall of the paint applicator 16 and the interior sidewall of the applicator guide 18. Moreover, FIGS. 7 and 8 illustrate the positioning of the applicator guide 18 relative to the side bristles 44 when in the lower position (FIG. 7) and when in the upper position (FIG. 8). A significantly larger portion of the bristles 44 are exposed when the applicator guide 18 is in the upper position (FIG. 8) rather than when the applicator guide 18 is in the lower position (FIG. 7).

FIGS. 7 and 8 also illustrate an alternative embodiment of the paint trimmer 10 wherein the lowering of the trigger 24 is not actuable via gravity itself. In these embodiments, the applicator guide 18 engages the base 12 via a set of ratcheting teeth 46. The ratcheting teeth 46 are partially formed from a plurality of complementary extensions and indentations formed along the interior sidewall of the applicator guide 18 and the exterior sidewall of the base 12. The ratcheting teeth 46 interact to engage and hold the applicator guide 18 in a stationary position. For example, in FIG. 7 the applicator guide 18 is in the lower position. Accordingly, the lower ends of the applicator guide 18 encompass the side bristles 44 and the paint applicator 16. A user may expose the side bristles 44 and the paint applicator 16 by compressing the trigger 24 toward the handle 14. The trigger 24 moves about a pivot toward the handle 14 and draws the applicator guide 18 upward via a connection thereto through the extension 26 and the bridge 28. The applicator guide 18 moves through the ratcheting teeth 46 while being raised. The ratcheting teeth 46 align parallel to the plane of the paint trimmer 10 to selectively position the applicator guide 18 relative to the base 12. The user may selectively position the applicator guide 18 with the trigger 24 in the lower position (FIG. 7), the upper position (FIG. 8) or any position intermediate the lower and upper positions. The intermediate position corresponds to any stationary position between the upper and lower positions the applicator guide 18 is in when a user releases the trigger 24. In this embodiment, the trigger ring 32 is particularly useful when the user endeavors to lower the positioning of the applicator guide 18 relative to the base 12. The trigger ring 32, as described above, is activated to selectively draw the trigger 24 away from the handle 14 to lower the positioning of the applicator guide 18 relative to the base 12. Again, the applicator guide 18 moves through the ratcheting teeth 46 until the desired position is reached. The ratcheting teeth 46 effective stationarily position the applicator guide 18 relative to the base 12.

Figure 9:
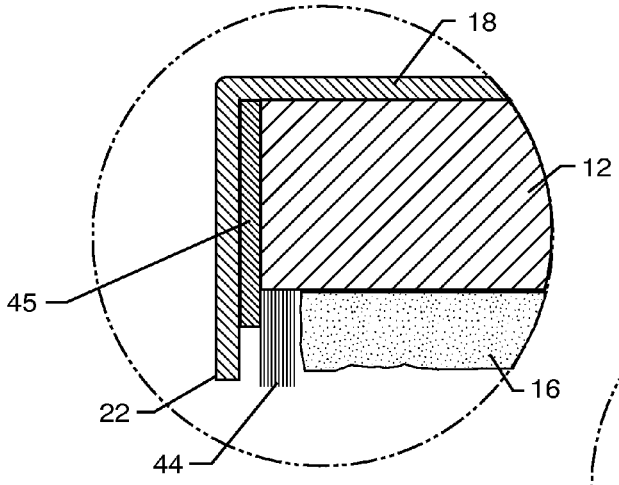
FIG. 9 is an enlarged alternative sectional view of the paint trimmer, taken about the circle 9 in FIG. 7, illustrating a spacer between the base and the applicator guide.
Figure 10:
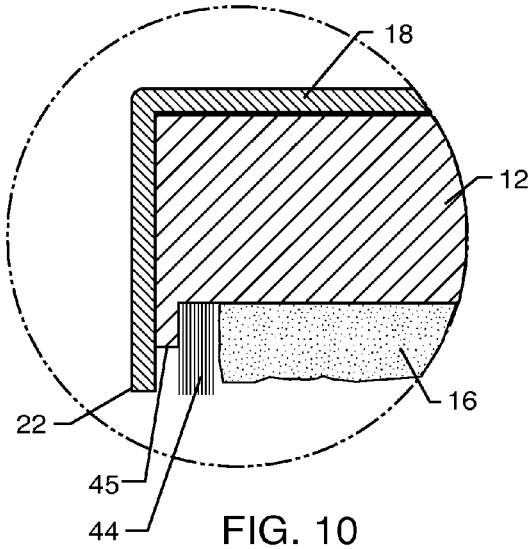
FIG. 10 is an alternative embodiment of FIG. 9, wherein the spacer is integrated into the base.

FIGS. 9-12 illustrate alternative embodiments of the positioning of the applicator guide 18 relative to the base 12, the paint applicator 16 and the side bristles 44. As shown in FIG. 9, a spacer 45 is disposed between the exterior of the base 12 and an interior of the applicator guide 18. This causes the interior of the applicator guide 18 to be offset from the exterior of the side bristles 44. As a result of this gap, the side bristles 44 are offset from and preferably do not engage the applicator guide 18. This ensures that paint disposed on the side bristles 44 does not dispense onto the applicator guide 18 and, as a consequence, spread to the guide edge 22. FIG. 10 illustrates an alternative embodiment wherein the spacer 45 is integral to the base 12. Again, the spacer 45 offsets the interior of the applicator guide 18 from the exterior of the side bristles 44 to ensure that paint thereon does not spread to the guide edge 22.

Figure 11:
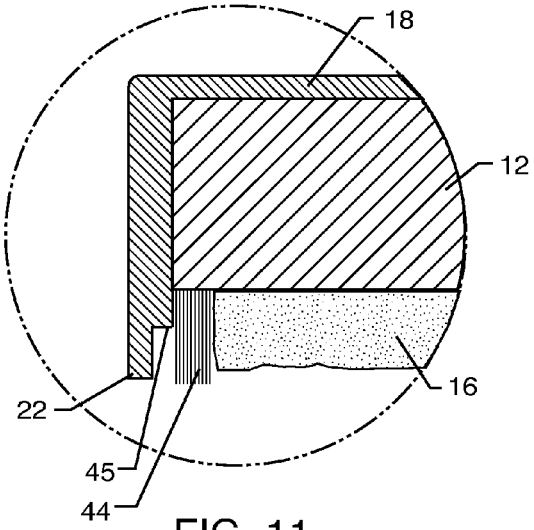
FIG. 11 is another alternative embodiment of FIG. 9, wherein the spacer is integrated into the applicator guide.
Figure 12:
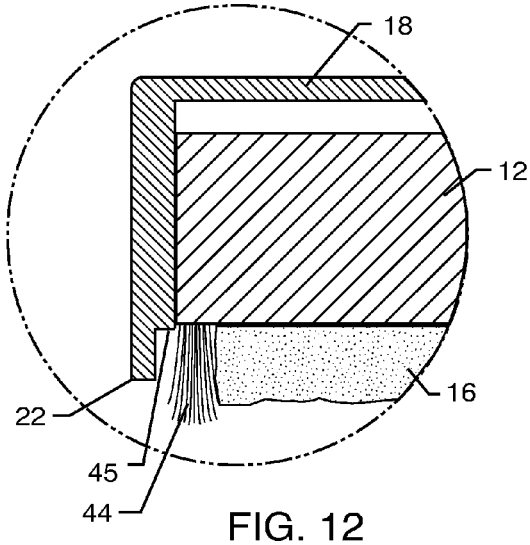
FIG. 12 is an enlarged sectional view of the paint trimmer, taken about the circle 12 in FIG. 8, illustrating disengagement of the spacer from the side bristles.

In another alternative embodiment, FIGS. 11 and 12 illustrate the spacer 45 integrated into the applicator guide 18. In this embodiment, the spacer 45 moves vertically with the applicator guide 18 in accordance with the embodiments described above. This may be particularly useful as the spacer 45 is used to provide an inward aligning pressure to the side bristles 44 so that a user may more accurately paint an edge around objects, such as a door frame. When the applicator guide 18 is moved upwardly as shown in FIG. 12, the side bristles 44 have a tendency to spread out and disperse. This is beneficial in the event that the paint trimmer 10 is used to paint larger surface areas as opposed to detailing around a door frame, for example. Even in the position shown in FIG. 12, the side bristles 44 preferably do not engage the applicator guide 18 so paint is not accidentally applied to the guide edge 22.

Figure 13:
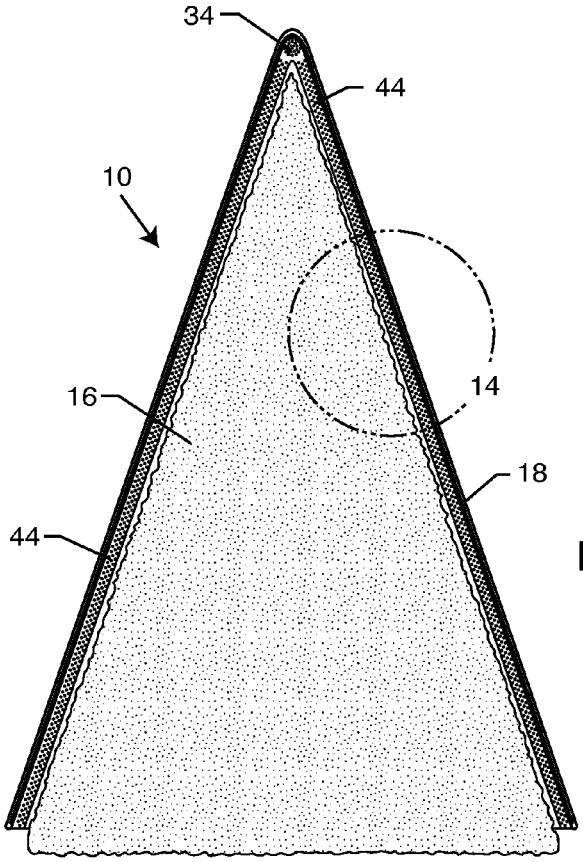
FIG. 13 is a bottom view of the paint trimmer.
Figure 14:
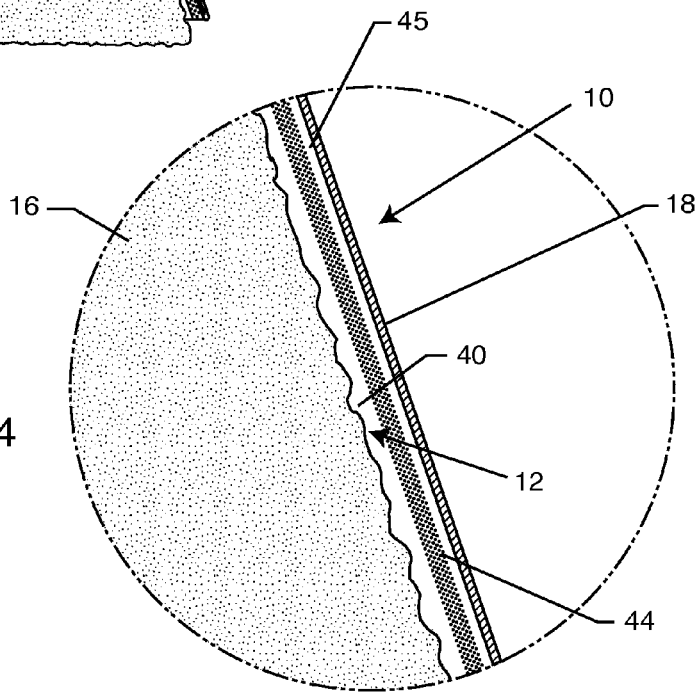
FIG. 14 is an enlarged sectional view of the paint trimmer, taken about the circle 14 in FIG. 13.

FIGS. 13 and 14 specifically illustrate the positioning of the paint applicator 16 relative to the side bristles 44, the extended bristles 34 and the interior perimeter sidewall of the applicator guide 18. Hence, when in the lower position, the applicator guide 18 fully covers the side of the paint applicator 16 and the side bristles 44 as best shown by the absence of these features in FIGS. 1 and 4. Alternatively, the paint applicator 16 and the side bristles 44 are fully exposed when the applicator guide 18 is fully raised to the upper position along the direction of the arrows shown in FIGS. 2 and 5. Moreover, the enlarged view of FIG. 14 illustrates the positioning of the spacer 45 between the applicator guide 18 and the side bristles 44. Preferably, the aggregate distance from the exterior of the side bristles 44 to the exterior of the applicator guide 18, which inherently includes the gap formed by the spacer 45, should not exceed 1/32 of an inch. The shorter the width between the exterior of the side bristles 44 and the exterior of the applicator guide 18, the closer a user may come to painting around, for example, door trim. In this regard, the spacer 45 and/or the paint applicator 16 may simply include a thin piece of plastic.

The applicator guide 18 is preferably made from plastic, rubber, metal or other materials commonly found in painting products. Plastic is preferred because it is less likely to scratch or otherwise damage a surface receiving paint from the applicator guide 18. In one embodiment, the applicator guide 18 comprises a uniform structure made from one of the above-identified materials. In an alternative embodiment, the applicator guide 18 may have an upper portion 48 made from a rigid material and a lower portion 50 made from a pliable or flexible material. The rigid upper portion 48 stabilizes the applicator guide 18 when the applicator guide 18 is raised and/or lowered by the trigger 24. The flexible lower portion 50 allows the applicator guide 18 to move and bend in response to contact to certain surfaces and/or edges. The flexible lower portion 50 may even conform to the surface over which a user applies paint with the paint trimmer 10. This feature of the flexible lower portion 50 allows a user to paint lines more closely to wood trim, cover plates, and other features surface features.

FIG. 15 illustrates an alternative embodiment of the paint trimmer 10, including a cantilevered lever 52 that extends from the bridge 28 coupled to the applicator guide 18. Like the trigger 24, the cantilevered lever 52 operates to move the bridge 28 and the applicator guide 18 between the upper and lower positions, as described above. The cantilevered lever 52 extends away from the handle 14 and toward the vertex 36 of the paint trimmer 10. Note that the positioning of the cantilevered lever 52 is opposite that of the aforementioned trigger 24. This embodiment merely provides an alternative placement of the mechanism for governing the position of the applicator guide 18 relative to the base 12, the paint applicator 16 and the extended bristles 34, for example. The cantilevered lever 52 pivots about a fulcrum 54 coupled to the connection mechanism 20 that interconnects the handle 14 with the base 12. The fulcrum 54 is preferably positioned to the side of the connection mechanism 20. The cantilevered lever 52 further includes a lever ring 56. The lever ring 56 functions similarly to the aforementioned trigger ring 32 in that a user may selectively position the applicator guide 18 through displacement of the cantilevered lever 52 about the fulcrum 54 via the lever ring 56. In the embodiment shown in FIG. 15, when a user pushes downwardly on the lever ring 56, the cantilevered lever 52 turns about the fulcrum 54 and the bridge 28 is raised thereby raising the applicator guide 18. When a user pulls up on the lever ring 56, the cantilevered lever 52 turns about the fulcrum 54 in the opposite direction and the bridge 28 is lowered, thereby lowering the applicator guide 18. This particular design may further include and/or employ the use of the ratcheting teeth 46 as described above with respect to FIGS. 7 and 8. Note also that the alternative paint trimmer 10 depicted in FIG. 16, as described in more detail below, also includes the aforementioned cantilevered lever 52, the fulcrum 54 and the lever ring 56. The mechanism works similarly as was described with respect to FIG. 15.

FIG. 16 is cross-sectional view of the paint trimmer 10 illustrated in FIG. 15. In this embodiment, the paint trimmer 10 enables a user to deliver paint directly to the paint applicator 16 via a passageway 58 fluidly coupled to a bladder 60 retaining a desired color and quantity of paint. The combination handle 14 and bladder 60 design is also preferably comfortable to grip for a user of the paint trimmer 10. As illustrated in FIG. 16, the handle 14 may include the bladder 60 integral thereto. Alternatively, the bladder 60 may be separate from the handle 14, for example, as a separate attachment. The bladder 60 fluidly couples to the paint applicator 16 via the passageway 58 and through the base 12. The bladder 60 can be filled by drawing paint up from a paint supply (not shown) through, e.g., the passageway 58. Of course, there are other ways to draw paint up into the bladder 60 other than by means through the paint applicator 16. These embodiments are described in more detail below. When the bladder 60 contains paint and is squeezed by a user, paint is directed through the passageway 58 and to the paint applicator 16 for application of the paint to a surface. In this embodiment, a user may selectively dispense paint from the reservoir in the bladder 60 to the paint applicator 16, as desired. The bladder 60 decreases the need to resupply the paint trimmer 10 so a user may paint for longer durations. Paint may also be dispensed by a pump integral therewith.

Figure 17:
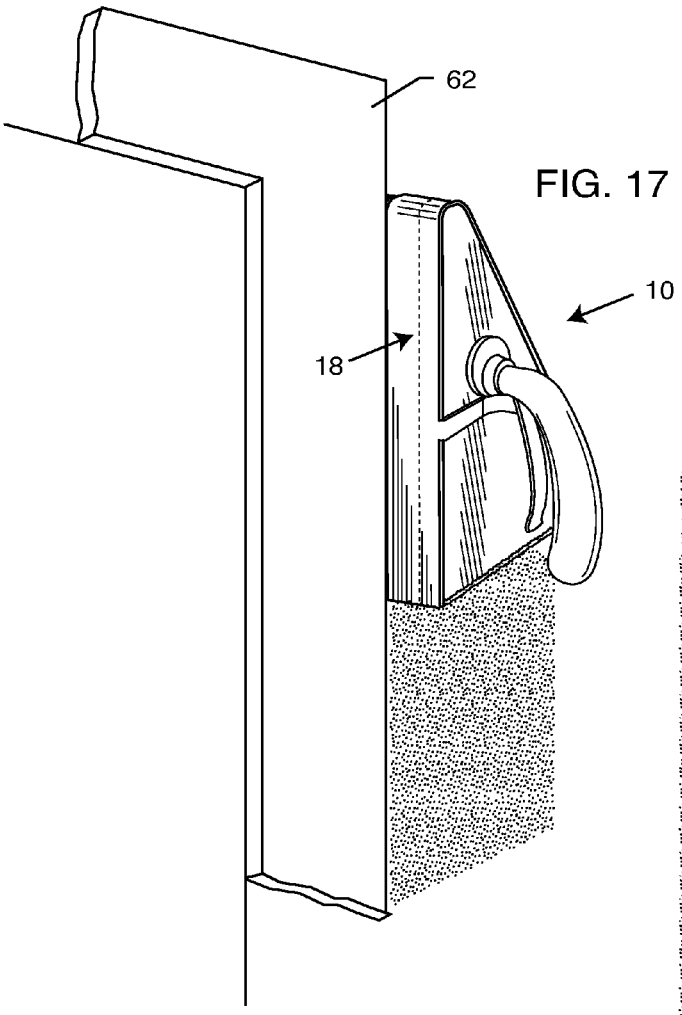
FIG. 17 is an environmental view illustrating the use of the paint trimmer to paint around a trim of a door jamb.
Figure 18:
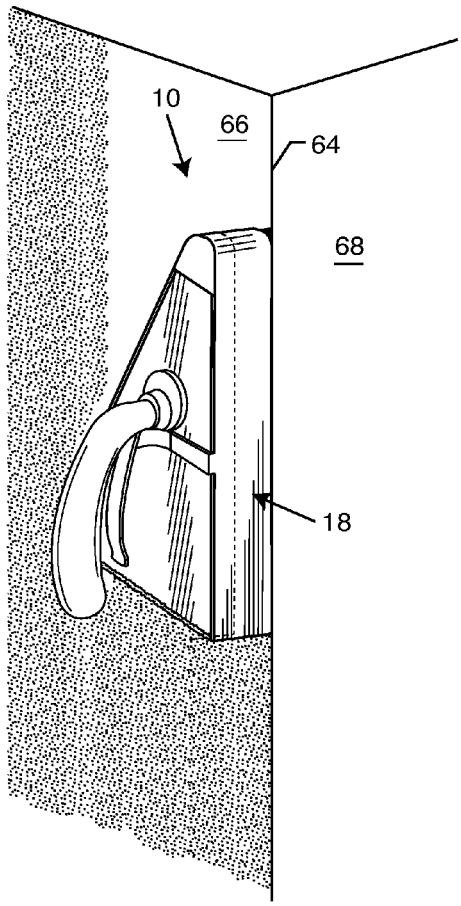
FIG. 18 is an environmental view illustrating painting a corner edge with the paint trimmer.
Figure 19:
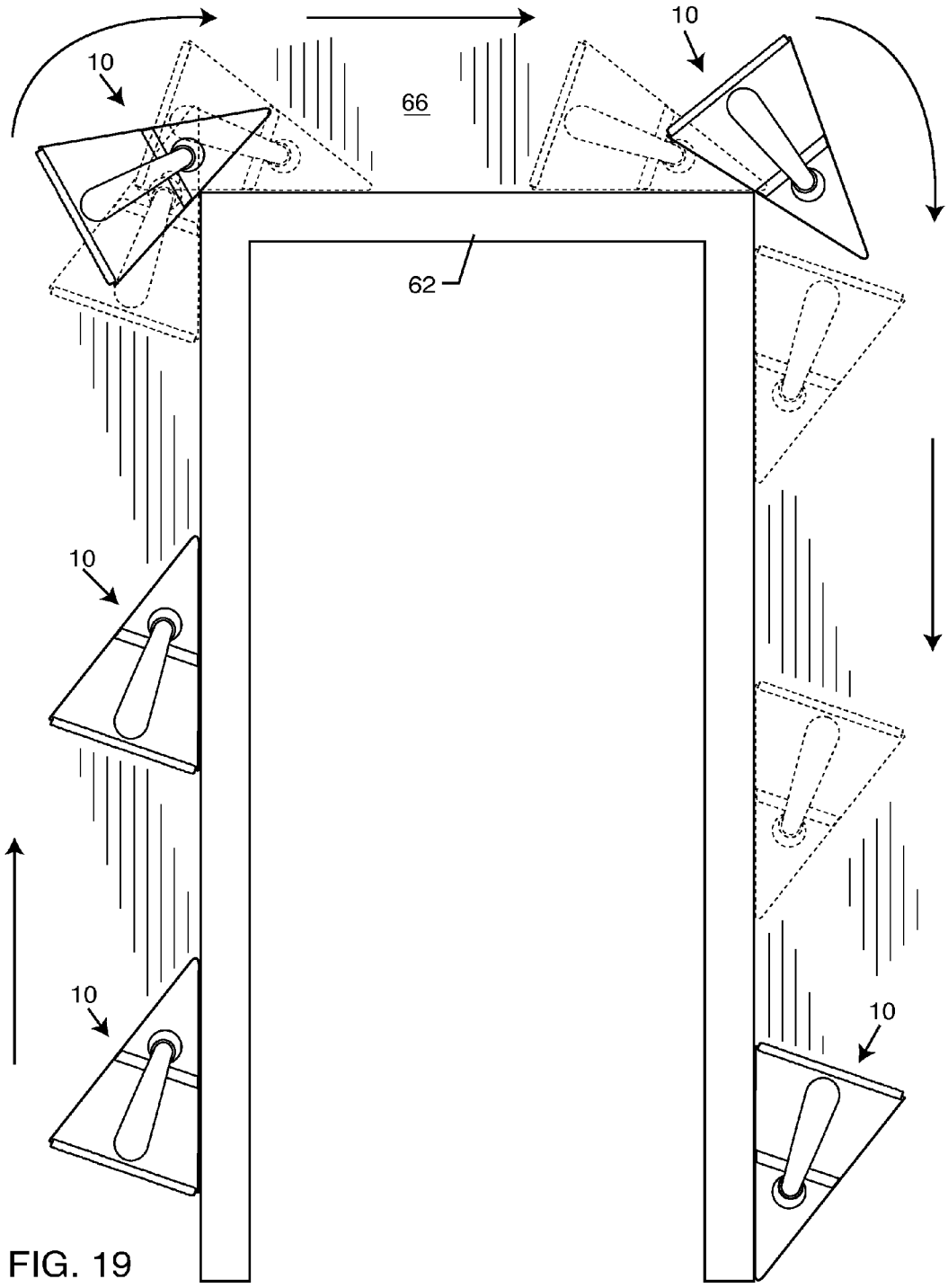
FIG. 19 is an environmental view illustrating painting around the edge of a door jamb with the paint trimmer.

FIGS. 17-19 illustrate several embodiments wherein the paint trimmer 10 is used to paint straight lines, paint along edges and paint around objects. For example, when painting along the edge of a wall trim 62 or along a corner 64 of a wall 66, a user positions the applicator guide 18 in the lower position, as shown in FIGS. 17 and 18. When the paint trimmer 10 is used against the wall trim 62 or along the wall 66, the applicator guide 18 prevents the application of paint on the side of the wall trim 62 or on an adjoining wall 68 (FIG. 18). This is accomplished because the applicator guide 18 encompasses the outer most side bristles 44 and the paint applicator 16. In this regard, the offset nature of the applicator guide 18, and specifically the guide edge 22, relative to the exterior of the side bristles 44 is particularly important. This ensures that a user can paint straight, clean lines along wood trim or corners with the paint trimmer 10 without the need to apply masking tape or use a separate paint masking tool.

Additionally, a user can quickly and easily paint around the entirety of the wall trim 62 with the paint trimmer 10, as shown in FIG. 19, due primarily to the triangular construction of the base 12. This is accomplished by positioning the applicator guide 18 in the lower position, as described above, and abutting the applicator guide 18 next to the wall trim 62 as shown in FIG. 19. A user then slides the paint trimmer 10 across the outer periphery of the wall trim 62 along the directional arrows shown therein. This is particularly advantageous over paint brushes or rollers because a user may apply paint to the wall 66 in a single motion without the need of masking tape or other paint masking devices or materials. Furthermore, the applicator guide 18 does not require the user to specifically align or place paint masking type materials along the exterior periphery of the wall trim 62 to create an even and straight paint line. One will realize that the paint trimmer 10 will allow a painting job, such as around the wall trim 62, to be completed with relative ease and speed.

Figure 20:
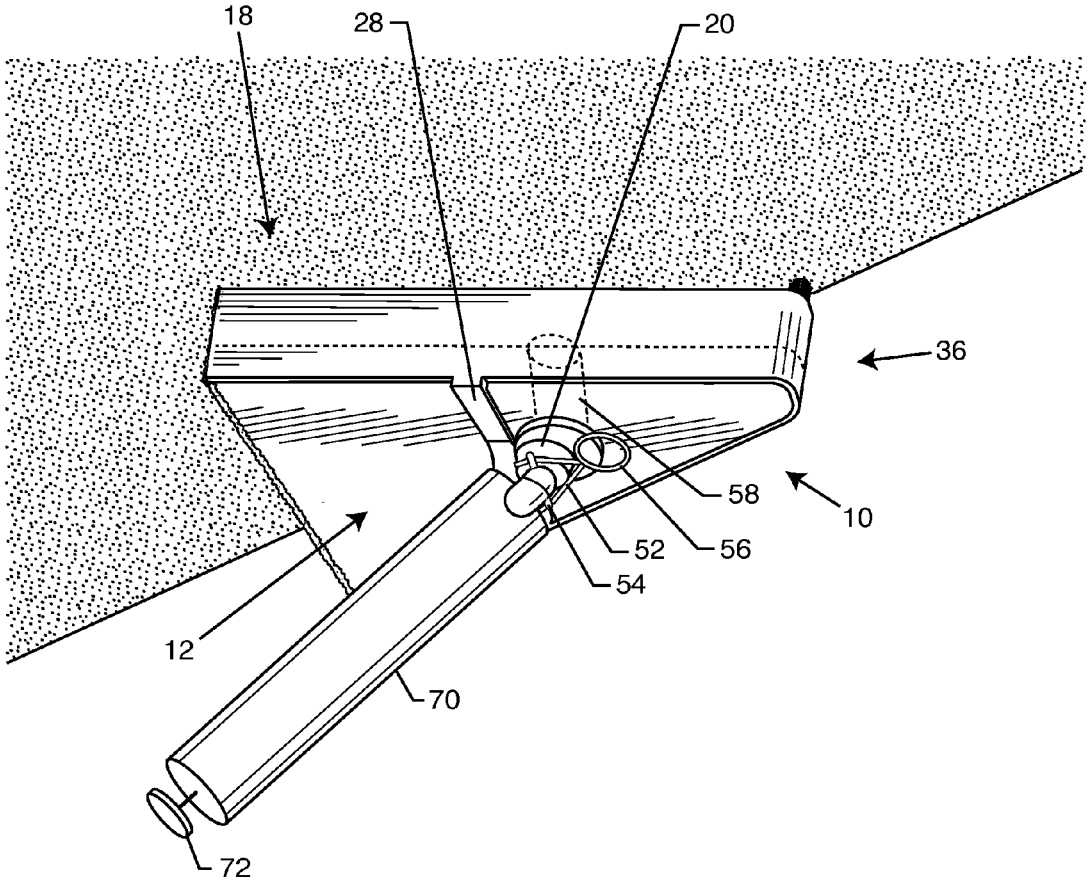
FIG. 20 is a perspective view of an alternative paint trimmer having a paint tube for a handle.

FIG. 20 illustrates another alternative embodiment of the paint trimmer 10, wherein a paint tube 70 is used in place of the aforementioned handle 14. For example, the handle 14 may be designed to selectively detach from the connection mechanism 20. This enables a user to disconnect and replace the handle 14 with one of a plurality of the different handles 14 described herein, or with the paint tube 70. In the embodiment in FIG. 20, the paint tube 70 attaches to the base 12 via the connection mechanism 20 and is thereafter fluidly coupled with the passageway 58 that supplies paint to the paint applicator 16 (not shown). The paint tube 70 is designed to hold a supply of paint therein. Of course, the paint in the paint tube 70 may vary in color, style, texture, etc. This enables manufacturers to pre-make and fill the paint tube 70 with various types of paints consumers may want to purchase. The removable aspect of the paint tube 70 enables a user to dispose of the paint tube 70 after all the paint is used. Alternatively, a user may selectively detach the paint tube 70 to be refilled at a local paint shop. The paint tube 70 may even be selectively detachable from the paint trimmer 10 and configured to be washed and refilled with a new supply of paint, e.g. with a different color. Alternatively, the paint tube 70 may be designed so a user must throw away the paint tube 70 after all the paint is dispensed. The paint tube 70 includes a plunger 72 designed to force or dispense paint out through the paint tube 70 and into the passageway 58. The plunger 72 preferably includes some form of ratcheting mechanism similar to that of a caulking gun. Although, a person of ordinary skill in the art will readily recognize that any one of a plurality of mechanisms may be substituted for the plunger 72 as long as the plunger 72 is able to fully dispense the paint contained within the paint tube 70. Paint dispensed by the plunger 72 goes through the connection mechanism 20 and into the passageway 58 for application to the paint applicator 16. The paint tube 70 is ideal to enable a user to use the paint trimmer 10 on a ceiling while still forcing paint to the paint applicator 16. As with other embodiments, the applicator guide 18 operates to protect surrounding surfaces from receiving paint released by the paint applicator 16 through use of the paint tube 70 and the plunger 72.

Figure 21:
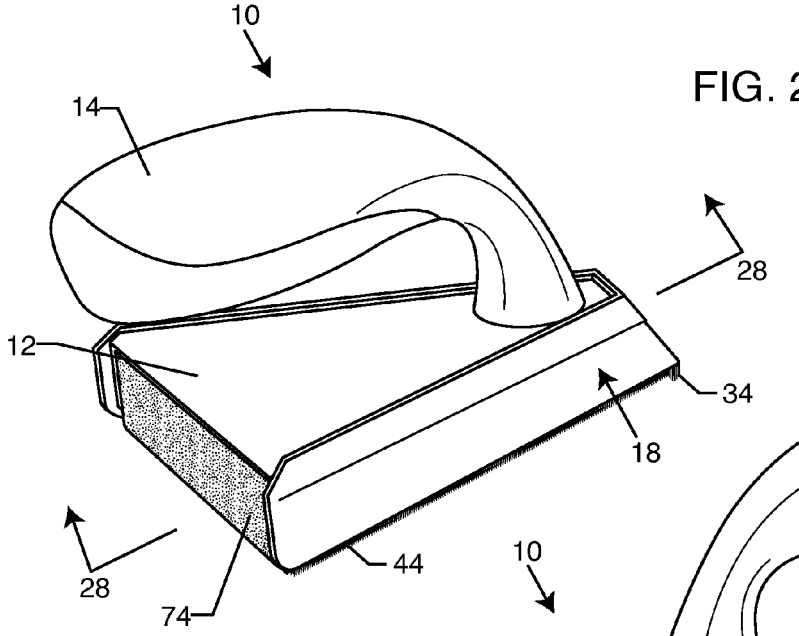
FIG. 21 is a perspective view of another alternative paint trimmer disclosed herein.
Figure 22:
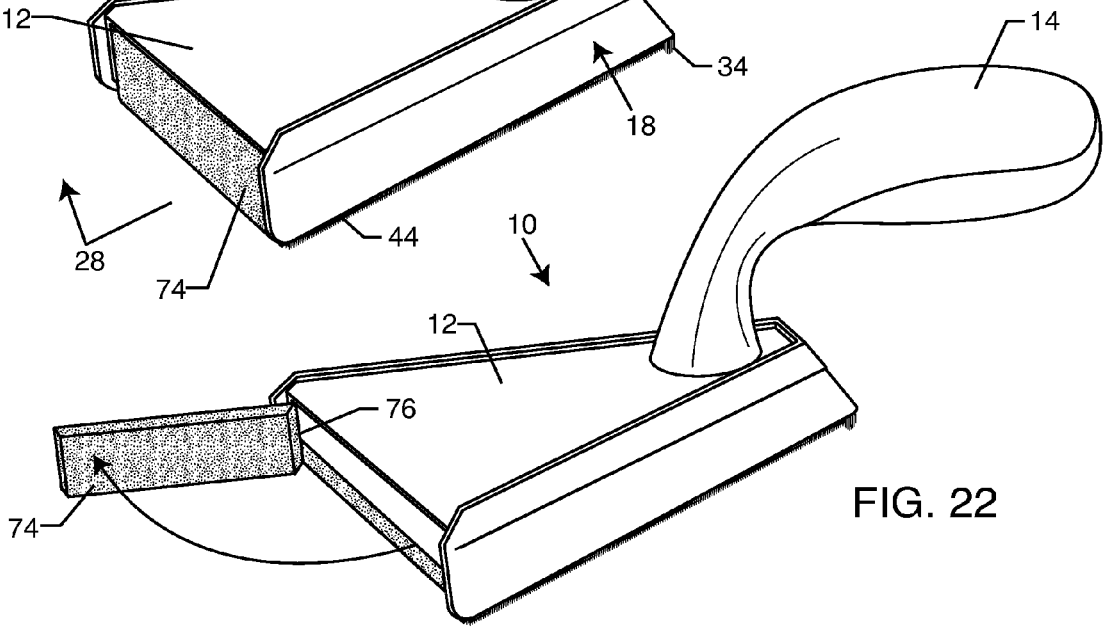
FIG. 22 is a perspective view of the paint trimmer of FIG. 21, illustrating pivoting a rear applicator about a vertical hinge.
Figure 23:
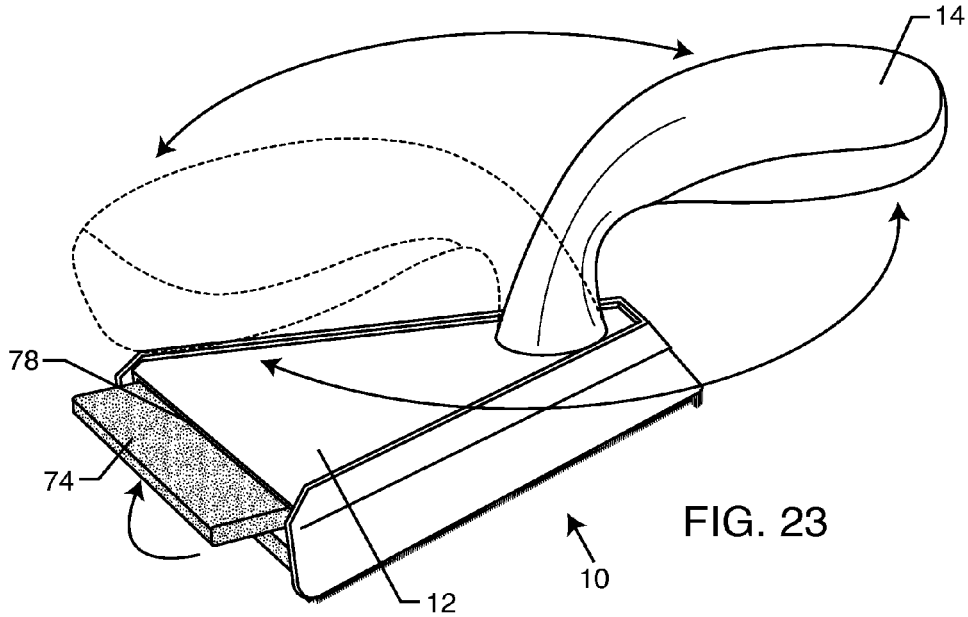
FIG. 23 is a perspective view of the paint trimmer of FIG. 21, illustrating pivoting the rear applicator about an alternative horizontal hinge and 360° rotation of the handle.

FIG. 21 illustrates another alternative embodiment of the paint trimmer 10 in accordance with the embodiments described herein. In this embodiment, the applicator guide 18 is fixed relative to the base 12, the paint applicator 16 (not shown), the extended bristles 34 and the side bristles 44. This embodiment further includes a selectively detachable rear paint applicator 74. For example, FIG. 22 illustrates the rear paint applicator 74 pivoting outwardly about a vertical hinge 76 integrated to the base 12. The vertical hinge 76 may be freely rotatable or include a step-lock mechanism such that the user may selectively stationarily position the rear paint applicator 74 between a closed position (FIG. 21) and an open position (FIG. 22). Opening the rear paint applicator 74 in the manner shown in FIG. 22 provides a user with additional paint trimmers. For example, a user may paint details with the side, corners or edges of the rear paint applicator 74 as deemed necessary per the respective paint job. Similarly, FIG. 23 illustrates the rear paint applicator 74 pivoting about a horizontal hinge 78. The vertical hinge 76 and the horizontal hinge 78 are designed to open and expose different portions of the paint applicator 16 for painting with the paint trimmer 10. Additionally, as shown in FIG. 19, the handle 14 rotates about the base 12 as designated by the rotational arrows therein. Preferably, the handle 14 rotates 360° about the base 12 such that a user may selectively position the handle 14 at any one of a number of different positions as desired. A lock may selectively statically position the handle relative to the base 12 at any location within that 360° range. The handle 14 may further include some type of ratcheting mechanism that enables a user to selectively step-lock the handle 14 relative to the base 12. This enables a user to turn the handle 14, for example from the position in FIG. 21 to the position in FIG. 22, to selectively open and use the rear paint applicator 74 for painting. This provides the user with more options and configurations for using the paint trimmer 10 in operation.

Figure 24:
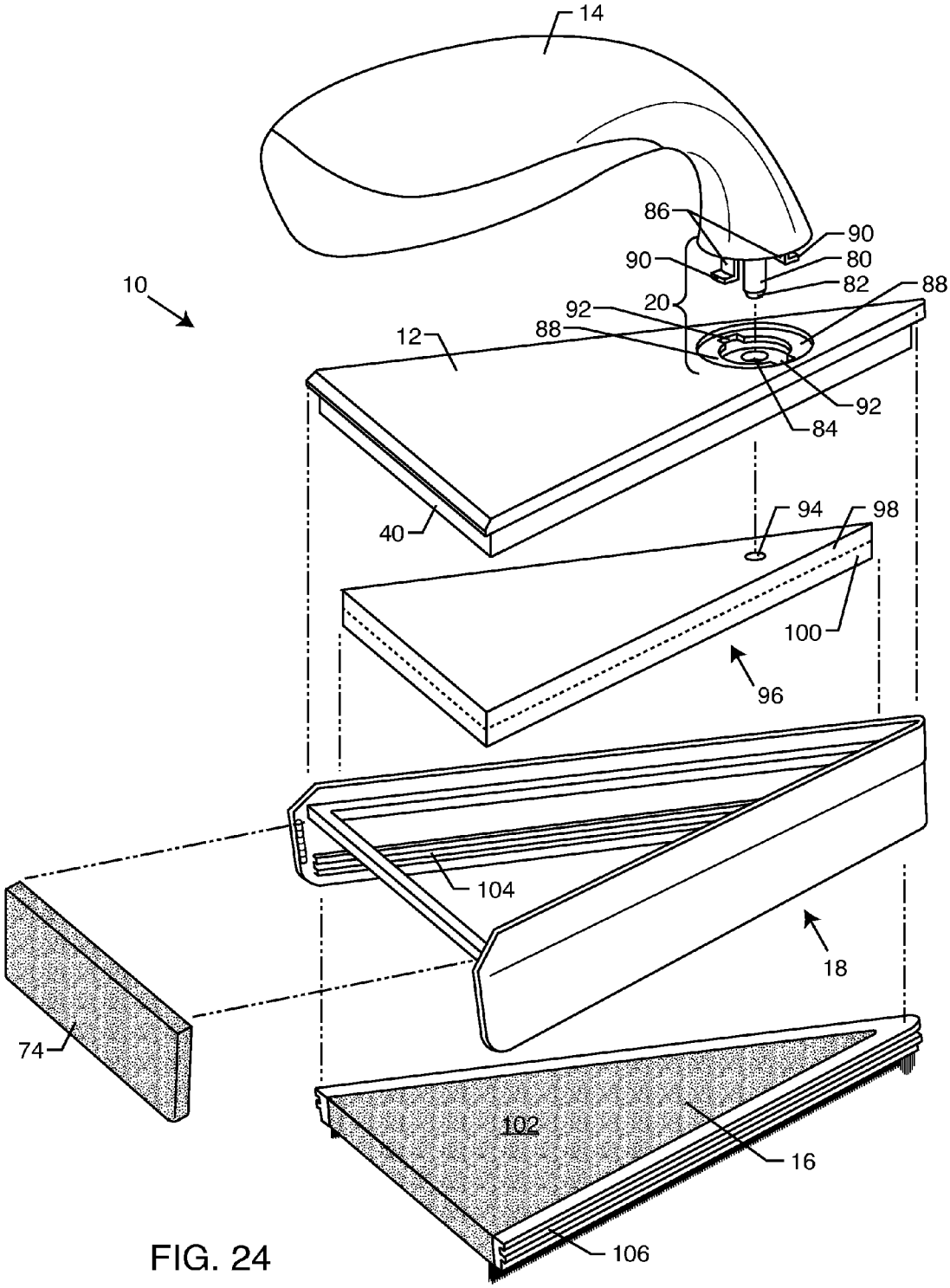
FIG. 24 is an exploded perspective view of the alternative paint trimmer of FIG. 21.

FIG. 24 is an exploded perspective view of one alternative paint trimmer 10 for use as described herein. As shown, the handle 14 couples to the base 12 via the connection mechanism 20. More specifically, in this embodiment the connection mechanism 20 includes a coupling so the handle 14 can inter-engage with the base 12. The handle 14 includes a guide pin 80 having a tapered head 82 that selectively slides into and engages an aperture 84 in the base 12. The handle 14 also includes a pair of hooks 86 extending downwardly and configured to engage a pair of slats 88 in the base 12. In this regard, a flange 90 of the hooks 86 inserts through a gap 92 next to the slats 88 as shown in FIG. 20. Once inserted, the handle 14 is rotated clockwise or counterclockwise such that the flanges 90 engage the slats 88. Here, the flanges 90 extend under and grab a portion of the slats 88. This ensures that the handle 14 does not release from the base 12 (except when the hooks 86 align with the gaps 92). The handle 14 remains attached to the base 12 as long as a portion of the flanges 90 extend up underneath at least a portion of the slats 88. In this regard, the flanges 90 need only be sufficiently engaged under the slats 88 to prevent inadvertent dislodgement of the handle 14 from the base 12 through the gaps 92. Alternatively, the handle 14 may further include a locking mechanism that prevents the handle 14 from rotating and otherwise inadvertently dislodging from the base 12.

As further shown in FIG. 24, the guide pin 80 extends through the aperture 84 in the base 12 and into an inlet 94 in a manifold 96. The manifold 96 generally comprises an upper section 98 and a complementary lower section 100 that fit together in a clam shell arrangement. The upper section 98 and the lower section 100 are sandwiched together between the lower surface 40 of the base 12 and an upper surface 102 of the paint applicator 16, respectively. Alternatively, the manifold 96 may be provided as a single piece of material wherein the upper section 98 and the lower section 100 are permanently sealed to one another. This is particularly preferable when the manifold 96 is permanently attached to the base 12 or the paint applicator 16, as described in more detail below. More details of the manifold 96 are discussed below with respect to FIG. 26. In general, the manifold 96 is configured to channel paint from the handle 14 to various locations on the upper surface 102 of the paint applicator 16.

Furthermore with respect to FIG. 24, the applicator guide 18 includes an internal guide rail 104 that selectively couples to an external guide rail 106 positioned around the exterior of the paint applicator 16. The complementary guide rails 104, 106 engage one another by any mechanism known in the art. For example, the internal guide rail 104 may slidably engage the external guide rail 106, or the internal guide rail 104 may fit over and snap into the external guide rail 106. The guide rails 104, 106 are designed to retain the applicator guide 18 in a stationary position relative to the paint applicator 16 and preferably include some locking mechanism. Accordingly, the guide rails 104, 106 may lock to one another through engagement of complementary slots that engage one another at 90°. Preferably, the guide rails 104, 106 snap into one another to some degree through use of a detent and a receptacle such that the applicator guide 18 does not accidentally dislodge from the paint applicator 16. Likewise, the base 12 preferably selectively removably snaps into a portion of the applicator guide 18 such that the base 12, the manifold 96, the applicator guide 18 and the paint applicator 16 interconnect and stay in a fixed position relative to one another. It is important that only those components designed to move, e.g. the handle 14 and the rear paint applicator 74, are able to move during use. The user should still be able to disassemble the paint trimmer 10 shown in FIG. 24 for purposes of cleaning (e.g. changing paint colors) the paint trimmer 10 or for other maintenance reasons.

Figure 25:
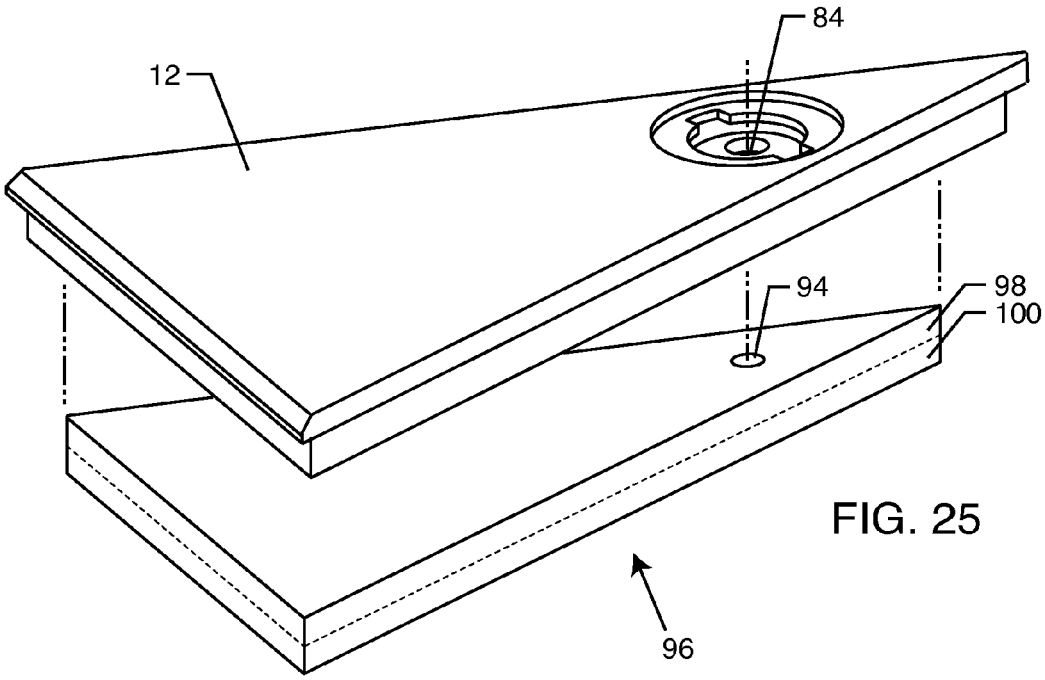
FIG. 25 is a partial exploded perspective view of a paint distributor relative to the base.
Figure 26:
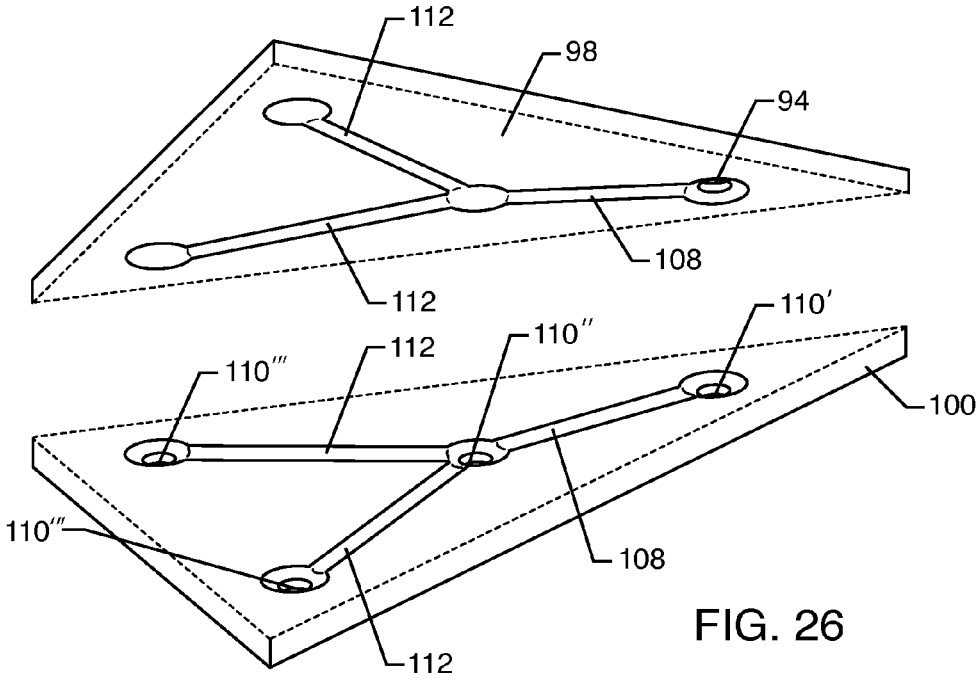
FIG. 26 is a perspective view illustrating the internal configuration of the distributor.

FIG. 25 illustrates the positioning of the manifold 96 relative to the base 12. Specifically, the inlet 94 of the manifold 96 concentrically aligns with the aperture 84 in the base 12. This enables a user to dispense paint from the handle 14 through the guide pin 80 and into the inlet 94. FIG. 26 further illustrates the internal configuration of the upper section 98 and the lower section 100 of the manifold 96. As shown, the inlet 94 is coupled to a trunk channel 108 formed between the upper section 98 and the lower section 100. Thus, paint travels from the handle 14, through the guide pin 80 and into the inlet 94 for distribution into the trunk channel 108, a plurality of distribution apertures 110 and a pair of branch channels 112 (also formed between the clam shell upper and lower sections 98, 100). Dispensing paint into the inlet 94 may initially cause the distribution aperture 110' to fill up and overflow due to being abutted against the upper surface 102 of the paint applicator 16 (best shown in FIG. 28). The overflowing paint then spills into the trunk channel 108 and travels toward the distribution aperture 110". Like the distribution aperture 110', the distribution aperture 110" will fill with paint thereby overflowing into the branch channels 112 and into the last of the distribution apertures 110". A person of ordinary skill in the art will readily recognize that the manifold 96 may include more or less channels 108, 112 or distribution apertures 110 depending on the size and structure of the paint trimmer 10. Preferably, the distribution apertures 110 are spaced evenly about the interior of the lower section 100 of the manifold 96 to ensure adequate and consistent coating of the paint applicator 16. It is otherwise undesirable to unevenly load certain sections of the paint applicator 16 with paint. Alternatively, paint may be dispensed and distributed within any of the distribution apertures 110, the trunk channel 108 or the branch channels 112. The important aspect is that the paint be distributed to the paint applicator 16 through the distribution apertures 110, the trunk channel 108 and the branch channels 112 as evenly as possible.

Figure 27:
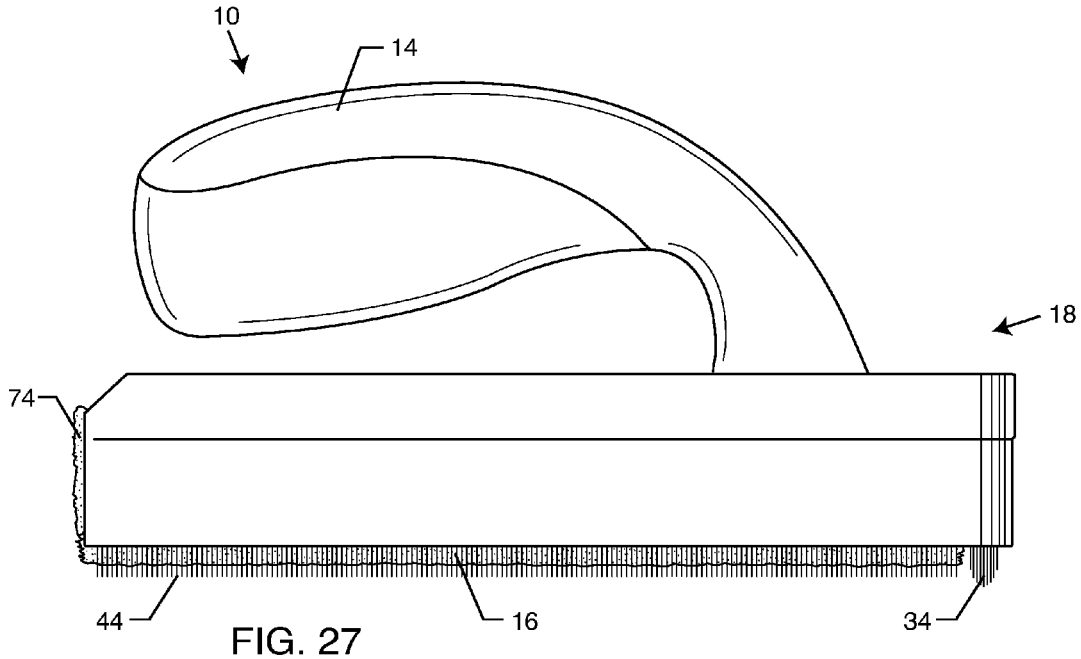
FIG. 27 is a side view of the paint trimmer of FIG. 21.

FIG. 27 illustrates a side view of the paint trimmer 10 and the relative positioning of the handle 14, the applicator guide 18, the paint applicator 16, the extended bristles 34, the side bristles 44 and the rear paint applicator 74. In this particular embodiment, the paint applicator 16, the extended bristles 34 and the side bristles 44 remain exposed as the applicator guide 18 is in a relatively fixed position relative to the base 12, as described above.

Figure 28:
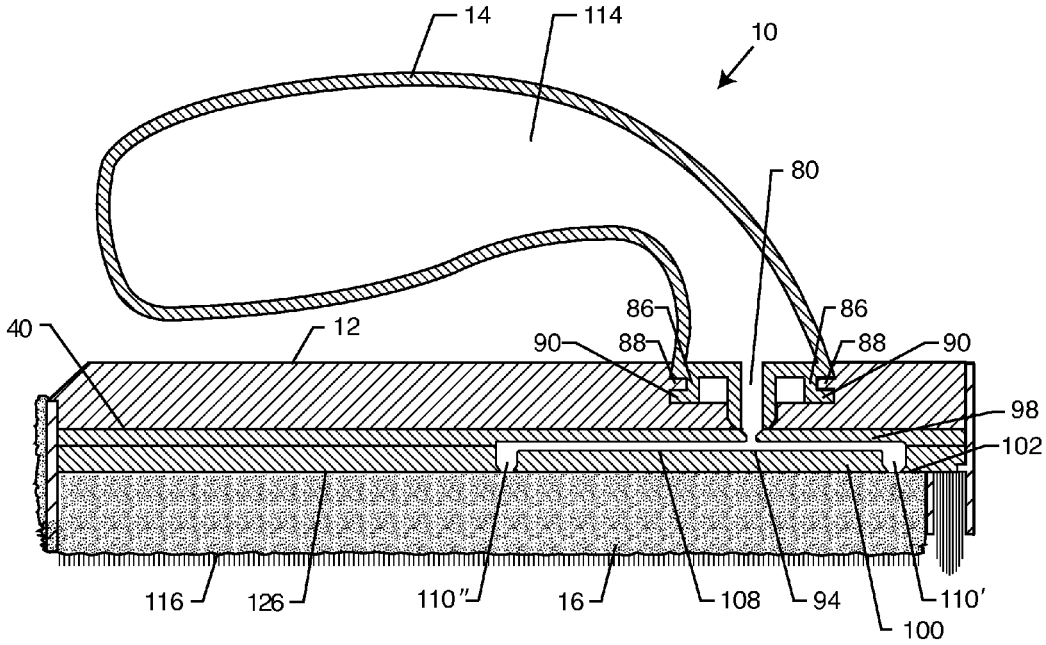
FIG. 28 is a cross-sectional view of the paint trimmer of FIG. 21, taken about the line 28-28.

Also shown in FIG. 28 are two embodiments wherein the manifold 96, which comprises the upper section 98 and the lower section 100, is integral either to the base 12 or the paint applicator 16. In the first embodiment, the upper section 98 of the manifold 96 may permanently attach to the base 12 at the lower surface 40 thereof. Preferably, a high strength glue ensures that the manifold 96 remains non-removably attached to the base 12. Alternatively, the base 12 and the upper section 98 and the lower section 100 of the manifold 96 may be formed as a single piece of material such that attachment of the manifold 96 is not reliant on an adhesive disposed along the lower surface 40 thereof. Accordingly, a user may selectively detach and replace the paint applicator 16 such that the manifold 96 remains secured to the base 12. In an alternative embodiment, the manifold 96 may be non-removably attached to the paint applicator 16. In this embodiment, a permanent adhesive is applied along an upper surface 126 of the paint applicator 16 to permanently secure the lower section 100 of the manifold 96 thereto. Also as part of this embodiment, the upper section 98 is permanently secured to the lower section 100 and therefore the manifold 96 comprises a single piece of material. Alternatively, the manifold 96 may be formed integral to the paint applicator 16 such that the permanent adhesive is not required to be disposed along the upper surface 126 to permanently attach the manifold 96 to the paint applicator 16. This embodiment is particularly preferable wherein a user may selectively detach the manifold 96 and the paint applicator 16 together. A new manifold 96/paint applicator 16 combination may be sold separately such that a user may simply replace the manifold 96 and the paint applicator 16 together when changing, for example, colors for use with the paint trimmer 10.

FIG. 28 illustrates the internal configuration of the paint trimmer 10 in accordance with FIGS. 21-27. As shown, the handle 14 includes a paint chamber 114 for storing paint to be delivered to the paint applicator 16. The handle 14 engages the base 12 by locking the hooks 86, and specifically the flanges 90, underneath the slats 88, as described above. The guide pin 80 extends through the base 12 and couples to the inlet 94 of the manifold 96. In this embodiment, paint dispenses from the inlet 94 into the trunk channel 108. The trunk channel 108 is fluidly coupled to the distributor apertures 110', 110". Paint then drips from the distribution apertures 110 onto the upper surface 102 of the paint applicator 16. The paint applicator 16 absorbs the paint through diffusion such that the paint is eventually exposed on a lower surface 116 thereof for application to a surface desired to be painted.

Figure 29:
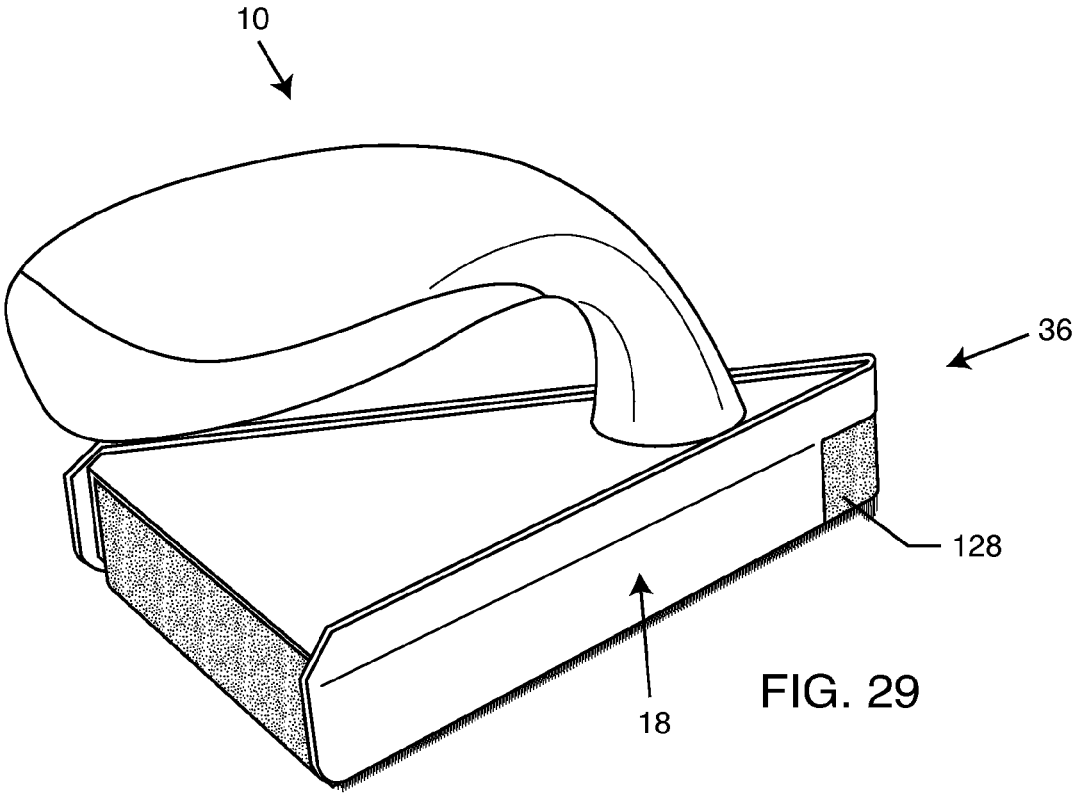
FIG. 29 is a perspective view of an alternative paint trimmer having a front applicator.
Figure 30:
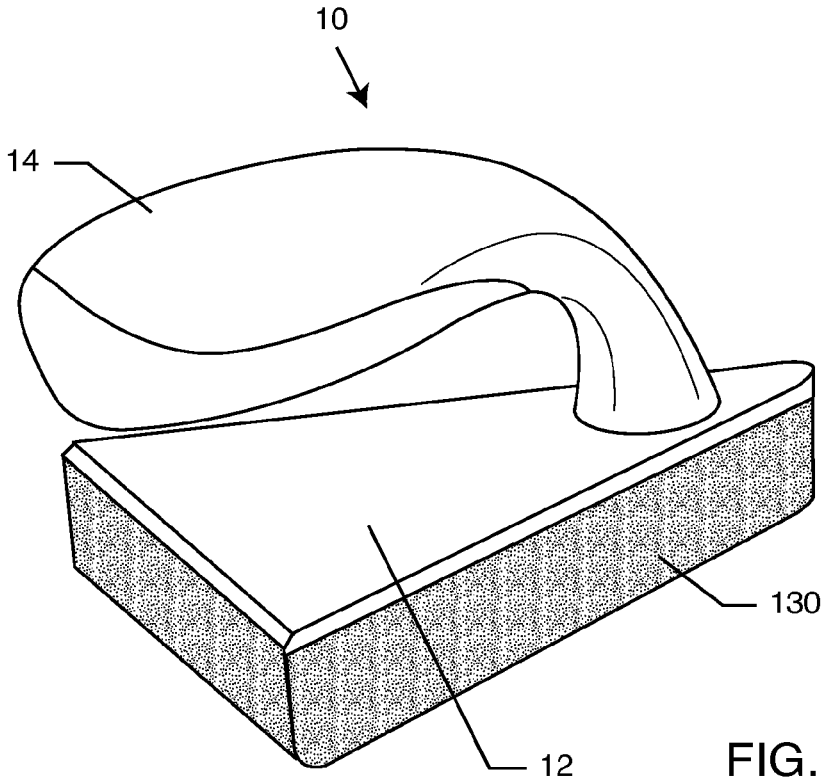
FIG. 30 is a perspective view of an alternative paint trimmer having a perimeter applicator.
Figure 31:
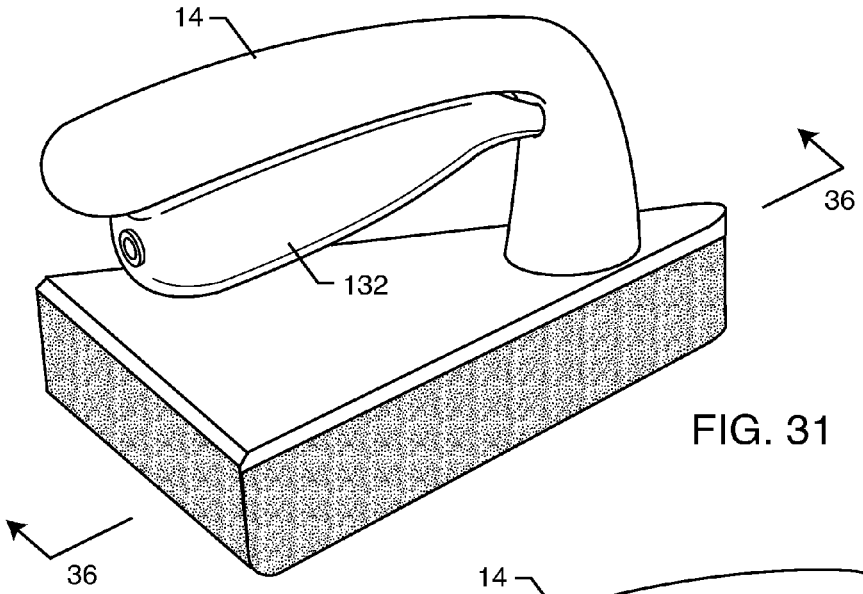
FIG. 31 is a perspective view of another alternative paint trimmer, including a selectively removable and refillable diaphragm.

FIGS. 29 and 30 illustrate alternative embodiments of the paint trimmer 10. In FIG. 29, the paint trimmer 10 includes a front paint applicator 128. The front paint applicator 128 may simply be exposed due to a cutout near the vertex 36 of the applicator guide 18. It is preferable that the front paint applicator 128 be fluidly coupled to the paint applicator 16 (not shown) such that the front paint applicator 128 may absorb paint therefrom via any of the previously described embodiments. Of course, the thickness of the front paint applicator 128 should be at least equal to the thickness of the applicator guide 18 so a user may easily apply paint with the front paint applicator 128 across, e.g., a smooth surface. Alternatively, the front paint applicator 128 may simply be a patch of applicator material applied to the external portion of the applicator guide 18. In this less preferable embodiment, a user would need to dip or otherwise apply paint to the surface of the front paint applicator 128 for eventual transfer to a surface to be painted.

FIG. 30 illustrates a similar alternative embodiment wherein the paint trimmer 10 includes a perimeter paint applicator 130. The perimeter paint applicator 130 essentially replaces the applicator guide 18. Preferably, the perimeter paint applicator 130 is also fluidly coupled to the paint applicator 16 such that paint diffuses thereto when dispensed by the handle 14 or via any of the other distribution methods described above. Alternatively, the perimeter paint applicator 130 may also be a patch of applicator material applied to the external portion of the base 12. Similarly, in this less preferable embodiment, a user would need to dip or otherwise apply paint to the surface of the perimeter paint applicator 130 for transfer to a surface to be painted.

Figure 32:
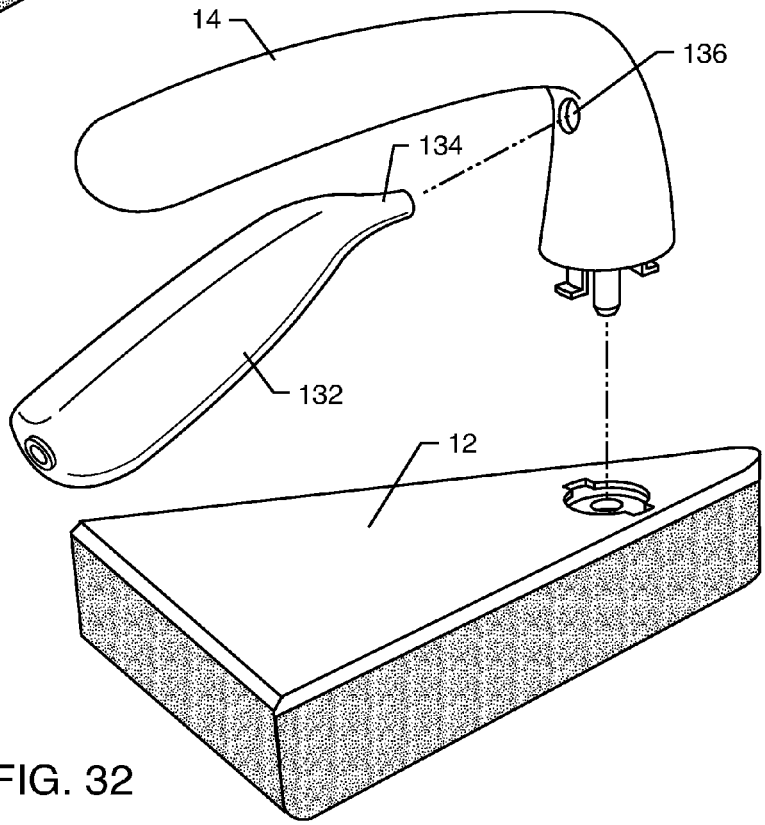
FIG. 32 is a partial exploded perspective view of the paint trimmer and diaphragm of FIG. 31.

FIGS. 31-36 illustrate an alternative embodiment wherein the handle 14 selectively couples to a diaphragm 132. The diaphragm 132 is preferably made from a flexible and compressible material such that a user may dispense paint therefrom by squeezing the diaphragm 132 with a hand (alone) or between a hand and the handle 14. FIG. 32 illustrates another alternate handle 14 universally configured to engage the base 12, as described above. In this embodiment, the handle 14 selectively receives the diaphragm 132 via a nozzle 134 that selectively couples to an inlet 136 in the handle 14. The interaction of the nozzle 134 with the inlet 136 is described in more detail below with respect to FIG. 36. The configuration of the diaphragm 132 enables a user to quickly and easily replenish a supply of paint or change colors depending on the paint job. Preferably, the diaphragm 132, or even the handle 14, is refillable via a one-way valve. The nozzle 134 preferably attaches to the inlet 136 by friction fit or another mechanism known in the art that effectively couples the two together.

Figure 33:
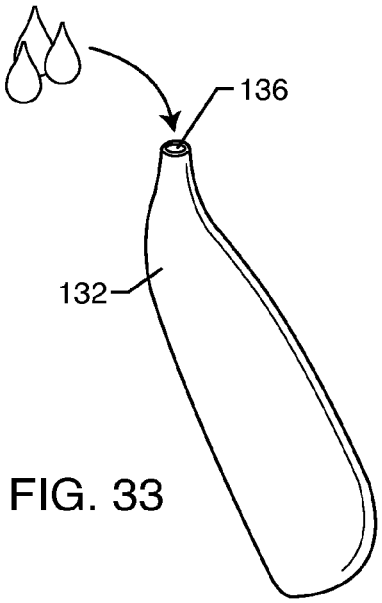
FIG. 33 is a perspective view of the diaphragm, schematically illustrating filling the diaphragm with paint.
Figure 34:
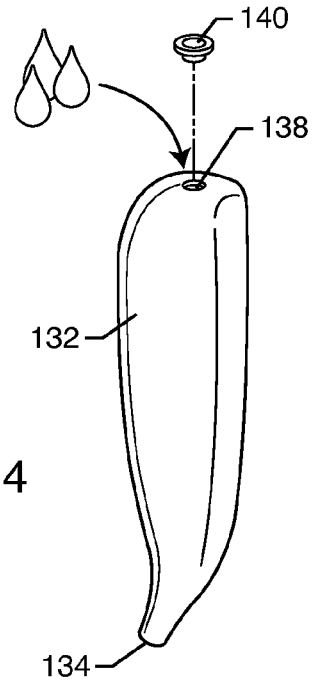
FIG. 34 is a perspective view of an alternative diaphragm having a refill port and a plug, schematically illustrating removal of the plug and filling the diaphragm with paint.
Figure 35:
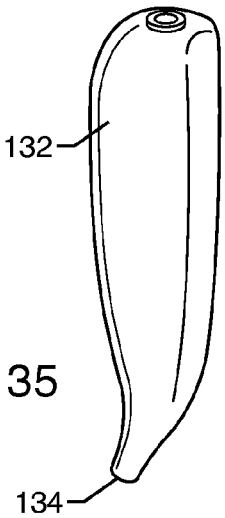
FIG. 35 is a perspective view of the alternative diaphragm of FIG. 34 having the end cap inserted into the plug.

FIGS. 33-35 illustrate the diaphragm 132 in multiple different configurations. For example, in FIG. 33, the diaphragm 132 only has the inlet 136. In this embodiment, if a user endeavors to refill the diaphragm 132, the user must do so through the inlet 136 as generally shown in the schematic in FIG. 33. Alternatively, as shown in FIGS. 34-35, the diaphragm 132 may include a refill aperture 138 that can be selectively plugged with a cap 140. In this embodiment, a user may fill the diaphragm 132 by removing the cap 140 from within the refill aperture 138. A temporary cap (not shown) may be disposed over the nozzle 134 to ensure paint poured into the refill aperture 138 does not immediately exit the diaphragm 132 out the other end. The paint trimmer 10 may be provided as part of a kit wherein the user has multiple diaphragms 132. The kit may also include a funnel insertable into the refill aperture 138 that aids in the ability to refill the diaphragm 132. FIG. 35 illustrates an embodiment, respective to FIG. 34, wherein the diaphragm 132 is filled with paint.

Figure 36:
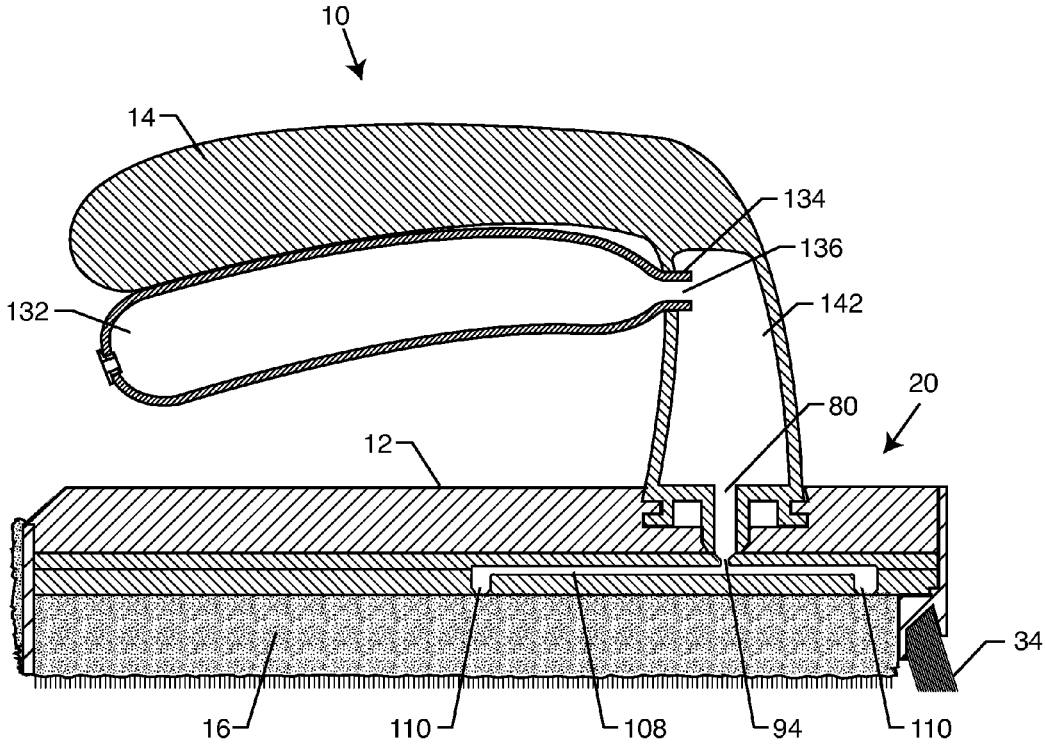
FIG. 36 is a cross-sectional view of the alternative paint trimmer of FIG. 31, taken about the line 36-36.

FIG. 36 is a cross-sectional view of the paint trimmer 10 including the diaphragm 132 having the nozzle 134 inserted into the inlet 136. The handle 14 depicted in FIG. 36 attaches to the base 12 through the same or similar connection mechanism 20 as described in detail above. The universal connection mechanism 20 enables a user to interchange multiple different types of handles 14 for use with the base 12. As shown specifically with respect to FIG. 36, the nozzle 134 inserts through the inlet 136 and into a receiving chamber 142. The diaphragm 132 is preferably flexible so a user may compress the diaphragm 132 and the contents inside. For example, the diaphragm 132 is compressible between the handle 14 and the hand of a user. A quantity of paint dispenses from within the interior of the diaphragm 132 into the receiving chamber 142 when the diaphragm 132 is compressed. The handle 14 then channels the paint in the receiving chamber 142 to the guide pin 80, through the inlet 94 to be dispersed to the paint applicator 16 via the trunk channel 108 and the distribution apertures 110, as described in detail above.

Figure 37:
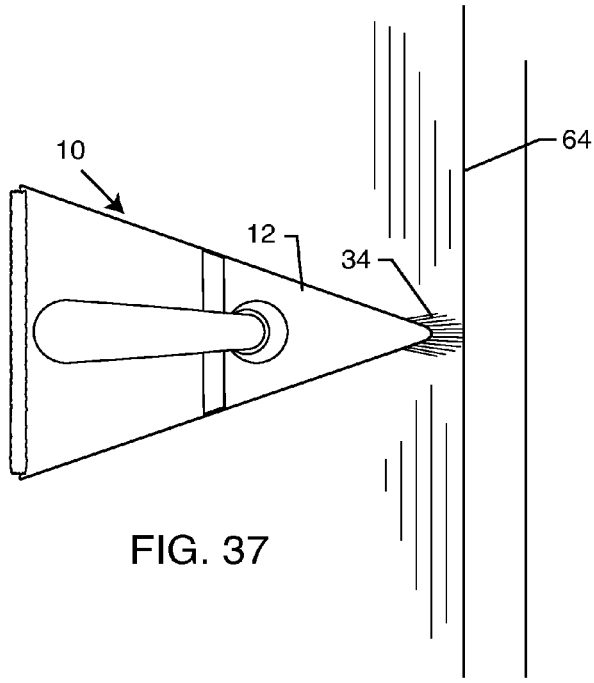
FIG. 37 is an environmental view illustrating painting around the edge of a door jamb with the angled extended bristles of the paint trimmer.

Also shown in FIG. 36 is an embodiment wherein the extended bristles 34 are angled at forty-five degrees toward the front of the paint trimmer 10. The angling of the extended bristles 34 enables a user to more closely paint around objects, for example, the wall trim 62 as shown in FIG. 37. Upon application of force to the paint trimmer 10, the angled extended bristles 34 of FIG. 36 disperse out from the base 12 so a user may closely paint along the edge of the wall trim 62.

Figure 38:
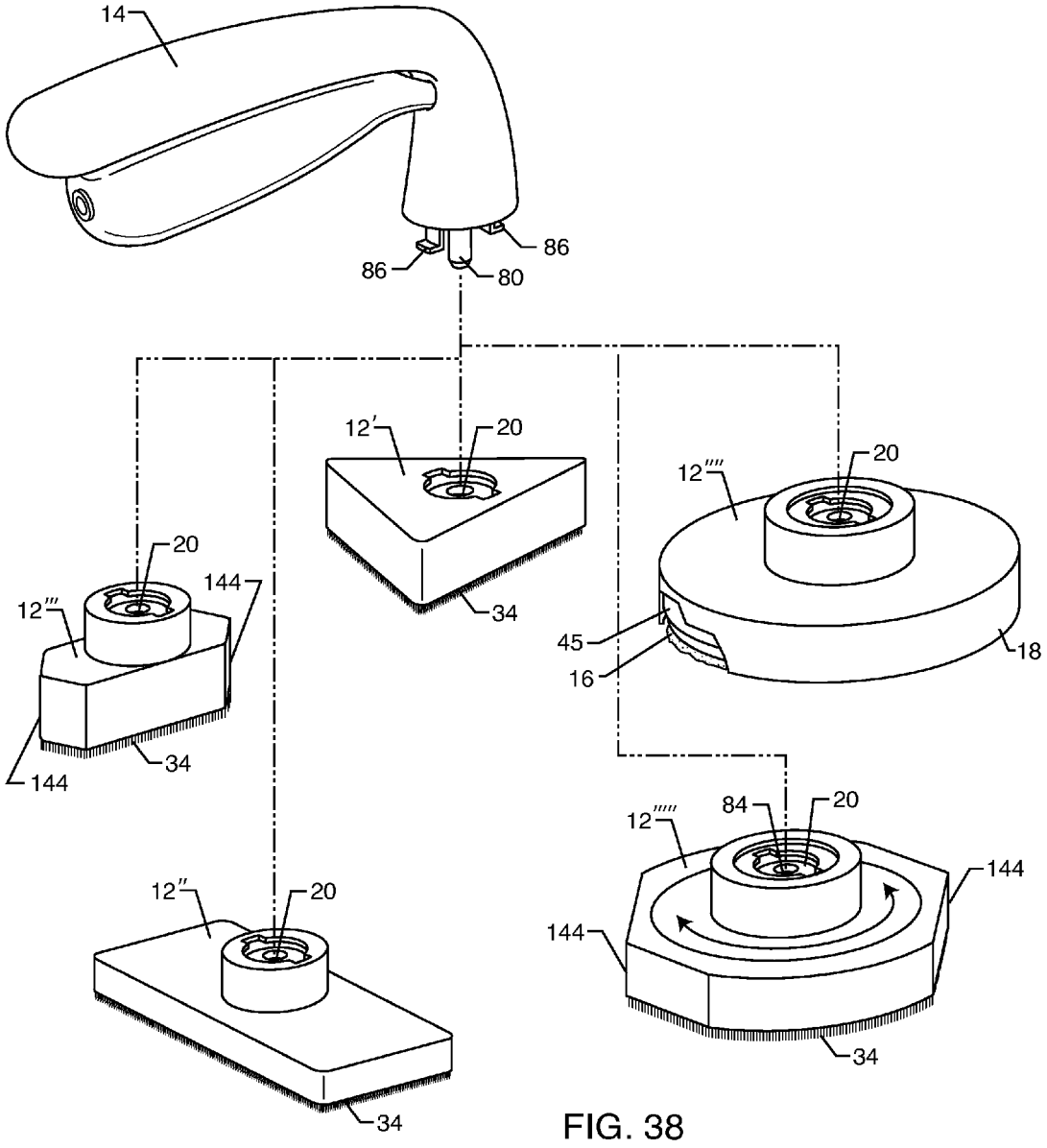
FIG. 38 is a perspective view of a universal handle compatible with several differently configured bases.

FIG. 38 illustrates multiple different bases 12, each including the aforementioned universal connection mechanism 20 that couples to the guide pin 80 and the hooks 86 of the handle 14. The handle 14 may comprise the one shown in FIG. 38, or any of the alternative embodiments of the handle 14, described above. Each of the alternative bases 12', 12", 12''', 12'''', 12''''' include a paint applicator 16 disposed around the interior of the as-shown extended bristles 34, in accordance with the embodiments described above. The base 12' is most similar in construction to the aforementioned base 12 in that it is triangular in construction. But, the base 12' is an equilateral triangle instead of an isosceles triangle. Alternatively, the base 12" may be rectangular in construction, the base 12''' may be relatively rectangular in construction and include a pair of triangular heads 144, or the base 12'''' may be circular. The circular base 12'''' illustrates the applicator guide 18 offset from the paint applicator 16 by the spacer 45. The base 12''''' is a hybrid between the circular base 12'''' and the triangular base 12', having a circular base with triangular heads 144. Additionally, the base 12''''' may rotate about an axis concentric to the aperture 84. Obviously, a person of ordinary skill in the art may substitute any one of the bases 12 with alternative embodiments in accordance with the paint trimmer 10.

Figure 39:
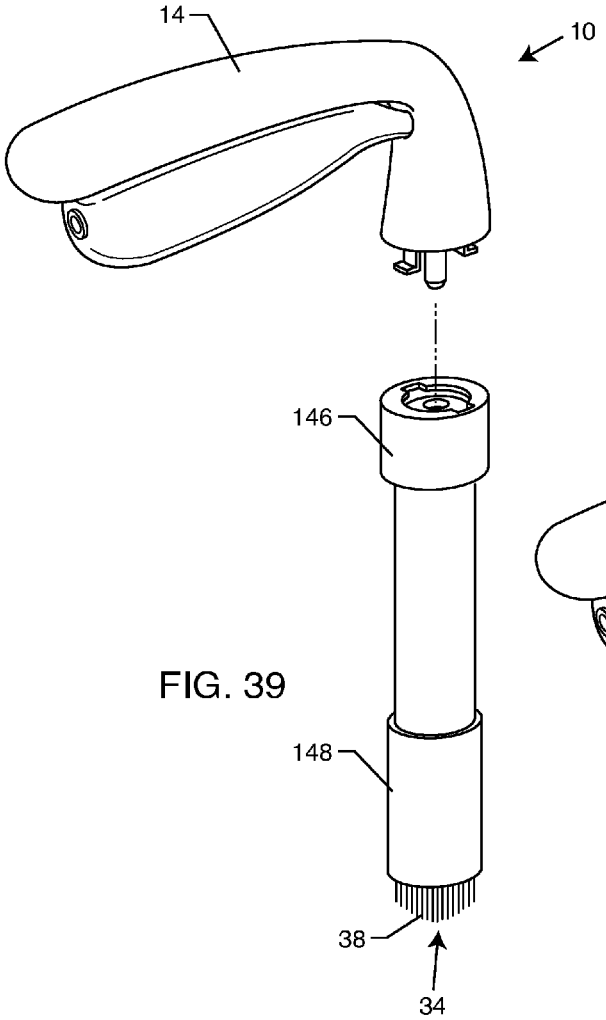
FIG. 39 is a partial exploded perspective view of the handle and alternative diaphragm relative to an alternative base.
Figure 40:
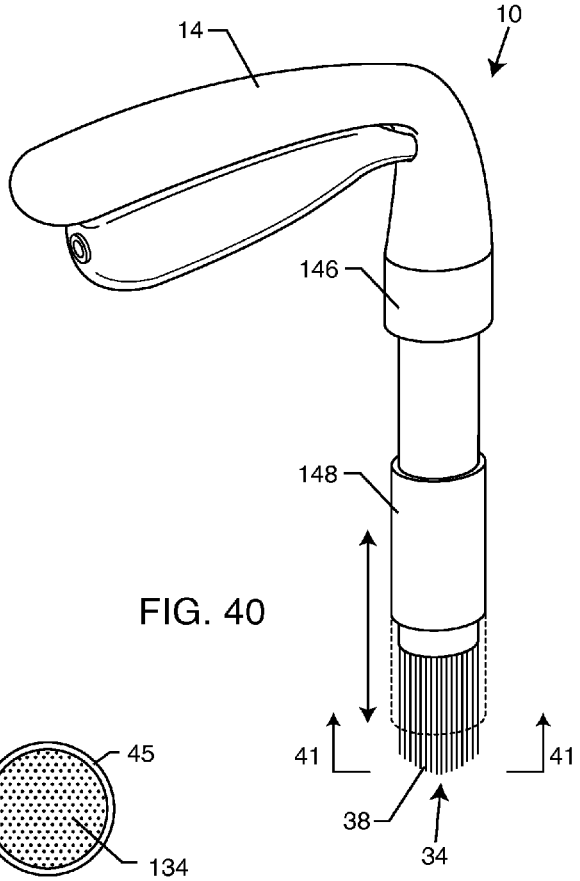
FIG. 40 is a perspective view illustrating the operational aspect of the handle and the alternative base of FIG. 39.
Figure 41:
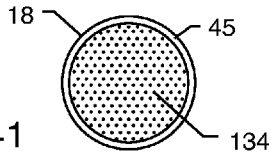
FIG. 41 is an end view of the alternative base of FIG. 39.

FIGS. 39-41 illustrate another alternative embodiment wherein the paint trimmer 10 includes the handle 14 that selectively couples to a tube 146 having the extended bristles 34 with the beveled tip 38. In this embodiment, the tube 146 includes a sleeve 148 selectively telescopingly positionable along the length of the tube 146. Sliding the sleeve 148 upwardly, as shown in FIG. 40, effectively exposes more of the extended bristles 34. Alternatively, lowering the sleeve 148 covers the longitudinal portion of the extended bristles 34 such that only the beveled tip 38 is exposed therefrom. As shown in FIG. 41, the sleeve 148 includes the applicator guide 18 offset from the extended bristles 34 by the spacer 45. The embodiments illustrated in FIGS. 39 and 41 are ideal for applying paint in hard to reach corners, circles or other areas that require detailing.

Figure 42:
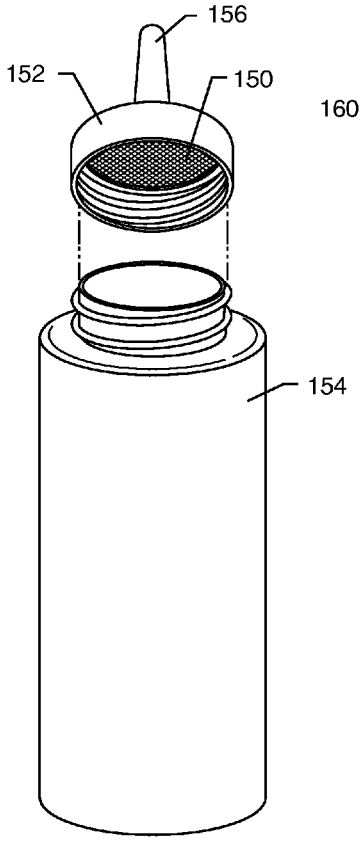
FIG. 42 is a perspective view of a nozzle paint dispenser for use with the paint trimmer.
Figure 43:
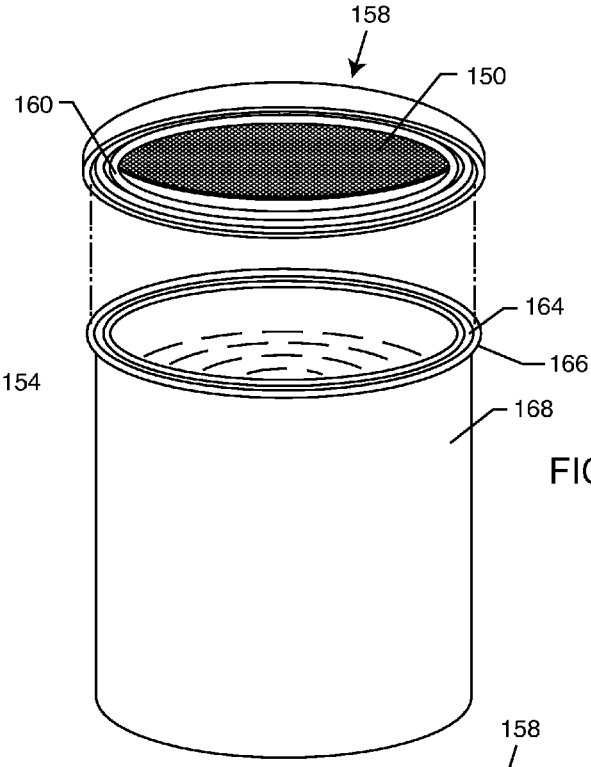
FIG. 43 is an exploded perspective view of a paint strainer and a paint can.

FIGS. 42-45 illustrate embodiments of a strainer 150 for use with the paint trimmer 10. In FIG. 42, the strainer 150 is integrated into a cap 152 that selectively attaches to a paint container 154. The cap 152 includes a nozzle 156 for selectively dispensing paint from within the interior of the paint container 154. The nozzle 156 is particularly preferred for use with the inlet 136 or the refill aperture 138 as shown in conjunction with the diaphragm 132 of FIGS. 33-35. The purpose of the strainer 150 is to remove contaminants such as dust or other debris from the paint stored within the paint container 154 upon transfer to the paint trimmer 10.

Figure 45:
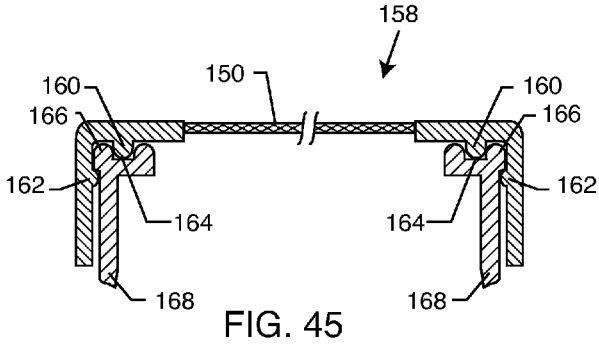
FIG. 45 is a cross-sectional view of the strainer and paint can, taken about the line 45-45 of FIG. 44.
Figure 44:
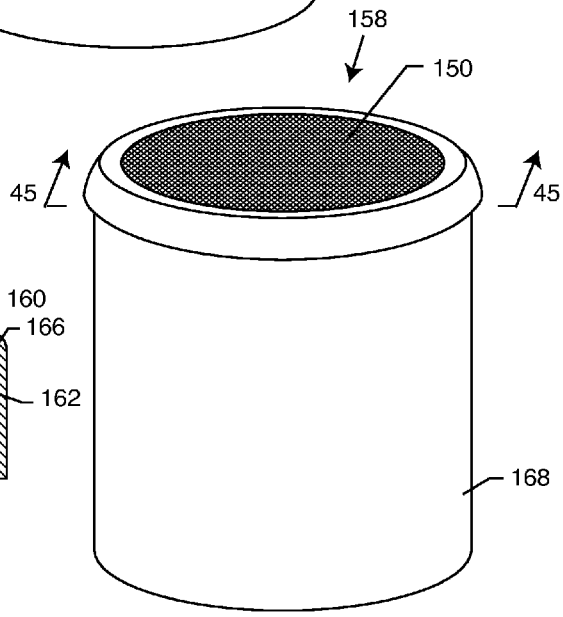
FIG. 44 is a perspective view illustrating the paint strainer attached to the paint can.

Similarly, the strainer 150 is used in association with a selectively attachable cover 158. The cover 158 includes an O-ring 160 and a latch ring 162 that selectively engage a channel 164 and a rim 166 at the top of the paint can 168. The purpose of the O-ring 160 is to selectively engage the channel 164 to prevent paint dispensed from within the paint can 168 from leaking. The latch ring 162 encompasses the exterior sidewall of the paint can 168 under the rim 166 to ensure that the cover 158 does not dislodge or otherwise fall off when pouring paint from within the interior of the paint can 168. Accordingly, FIG. 44 illustrates a perspective view of the cover 158 attached to the top of the paint can 168. Furthermore, FIG. 45 is a cross-sectional view illustrating engagement of the O-ring 160 of the cover 158 with the channel 164 formed in the paint can 168. Also shown in the cross-sectional view of FIG. 45 is the latch ring 162 engaging an exterior sidewall of the paint can 168 under the rim 166 to secure the cover 158 thereto. Accordingly, any paint dispensed from within the interior of the paint can 168 must travel through the strainer 150, thereby removing debris and other contaminants from the paint.

Although several embodiments have been described in detail for purposes of illustration, various modifications may be made to each without departing from the scope and spirit of the invention. Accordingly, the invention is not to be limited, except as by the appended claims.

What is claimed is:

1. A paint trimmer, comprising:

a rigid base;

a handle removably attachable to the base, the handle including a bladder for storing paint;

a paint applicator configured to match with and disposed completely along the entire area of the base;

a manifold fluidly coupling the bladder to the paint applicator; and a paint mask associated with the base and offset from the paint applicator.

2. The paint trimmer of claim 1, including a set of bristles disposed between the paint applicator and the paint mask.

3. The paint trimmer of claim 1, including a position controller associated with the paint mask and the handle, the position controller selectively adjusts the height of the paint mask relative to the paint dispenser.

4. The paint trimmer of claim 1, wherein the manifold is disposed between the base and the paint applicator.

5. The paint trimmer of claim 4, wherein the manifold includes a channel fluidly coupled to the bladder for dispensing paint to the paint applicator.

6. The paint trimmer of claim 1, wherein the bladder comprises a chamber in the handle or a compartment selectively attachable to the handle.

7. The paint trimmer of claim 1, wherein the bladder fluidly couples to the paint applicator through a passageway in the base.

8. The paint trimmer of claim 1, including a hinged paint applicator coupled to the base.

9. The paint trimmer of claim 8, wherein the hinged paint applicator vertically or horizontally pivots relative to the base.

10. The paint trimmer of claim 1, wherein the handle includes a guide pin that aligns the handle with the base and fluidly couples the bladder to the manifold.

11. The paint trimmer of claim 1, wherein the base includes a slat that selectively slidably receives a hook and flange extending from the handle for securing the handle to the base.

12. The paint trimmer of claim 1, including a perimeter paint applicator disposed at least partially around an exterior of the base.

13. The paint trimmer of claim 1, wherein the handle rotates 360 degrees about the base.

14. The paint trimmer of claim 1, wherein the paint applicator comprises a set of beveled bristles.

15. The paint trimmer of claim 1, including a lock for non-removably securing the handle to the base.

16. The paint trimmer of claim 1, including a squeezable pump for dispensing paint from the bladder.

17. The paint trimmer of claim 1, wherein the bladder is selectively refillable via a one-way valve.

18. The paint trimmer of claim 1, wherein the paint mask telescopes.

19. The paint trimmer of claim 1, wherein the paint mask comprises a rigid upper portion and a pliable lower portion.

20. The paint trimmer of claim 1, wherein the paint applicator and the manifold are selectively removable and replaceable.

21. The paint trimmer of claim 20, wherein the paint applicator permanently attaches to the manifold by an adhesive.

22. A paint trimmer, comprising:

a rigid triangular base, including a set of elongated bristles having a beveled edge at one vertex of the triangular base;

a handle removably attachable to the base, the handle including a bladder for storing paint;

a paint applicator associated with the base;

a manifold fluidly coupling the bladder to the paint applicator; and a paint mask associated with the base and offset from the paint applicator.

23. The paint trimmer of claim 22, wherein the elongated bristles extend from the base at a 45 degree angle.

* * * * *